US011605520B2

(12) United States Patent
Motes et al.

(10) Patent No.: US 11,605,520 B2
(45) Date of Patent: Mar. 14, 2023

(54) ANTI-ROTATIONAL FUSE END CAP

(71) Applicant: ABB SCHWEIZ AG, Baden (CH)

(72) Inventors: Aaron M. Motes, Ormond Beach, FL (US); Charles B. Bentley, Jr., Conover, NC (US); Daniel B. Guptail, Collierville, TN (US); Matthew D. Cawood, De Leon Springs, FL (US)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 17/656,146

(22) Filed: Mar. 23, 2022

(65) Prior Publication Data

US 2022/0310347 A1 Sep. 29, 2022

Related U.S. Application Data

(60) Provisional application No. 63/165,665, filed on Mar. 24, 2021.

(51) Int. Cl.

| | |
|---|---|
| ***H01H 31/12*** | (2006.01) |
| ***H01H 85/165*** | (2006.01) |
| ***H01H 85/055*** | (2006.01) |
| ***H01H 85/157*** | (2006.01) |

(52) U.S. Cl.

CPC ..... *H01H 85/165* (2013.01); *H01H 31/127* (2013.01); *H01H 85/055* (2013.01); *H01H 85/157* (2013.01)

(58) Field of Classification Search

CPC .. H01H 31/127; H01H 85/055; H01H 85/157; H01H 85/165

See application file for complete search history.

(56) References Cited

U.S. PATENT DOCUMENTS

| | | | | | |
|---|---|---|---|---|---|
| 994,566 | A * | 6/1911 | Bernadini | H01H 85/157 | 337/248 |
| 1,045,051 | A * | 11/1912 | Mallory | H01H 85/157 | 337/237 |
| 1,102,985 | A * | 7/1914 | Goldman et al. | H01H 85/157 | 12/146 BR |
| 1,109,733 | A * | 9/1914 | Young | H01H 85/157 | 337/250 |
| 1,124,133 | A * | 1/1915 | Hershey | H01H 85/157 | 337/236 |
| 1,270,391 | A * | 6/1918 | Eustice | H01H 85/157 | 337/248 |

(Continued)

*Primary Examiner* — Jacob R Crum

(74) *Attorney, Agent, or Firm* — Greenberg Traurig, LLP

(57) ABSTRACT

A fuse assembly having an end cap that includes a recessed retention body. The recessed retention body can include first and second retention walls and an engagement surface. The first and second retention walls can extend at least in a generally outwardly direction from the retention surface to an outer surface of the end cap, and extend between first and second ends of the first end cap in a direction that is generally parallel to a central longitudinal axis of the fuse assembly. The engagement surface can have one or more walls that downwardly and outwardly extend in divergent directions from an apex of the engagement surface and toward a corresponding one of the first or second retention walls. The apex can be positioned at a central location between the first and second retention walls, and extends in a direction that is generally parallel to the central longitudinal axis.

20 Claims, 10 Drawing Sheets

(56) References Cited

U.S. PATENT DOCUMENTS

| | | | | | |
|---|---|---|---|---|---|
| 1,318,886 | A * | 10/1919 | La Mar et al. | H01H 85/157 | 337/250 |
| 1,439,870 | A * | 12/1922 | Conant | H01H 85/055 | 337/292 |
| 1,485,211 | A * | 2/1924 | Berger | H01H 85/157 | 337/245 |
| 1,716,884 | A * | 6/1929 | Goss | H01H 85/157 | 337/248 |
| 2,292,907 | A * | 8/1942 | Sperling | H01H 85/044 | 337/260 |
| 2004/0135105 | A1* | 7/2004 | Hutcheson | G21F 5/015 | 250/506.1 |
| 2016/0240336 | A1* | 8/2016 | Weng | H01H 31/127 | |
| 2018/0114663 | A1* | 4/2018 | Pössnicker | H01H 85/0418 | |

* cited by examiner

ANTI-ROTATIONAL FUSE END CAP

CROSS-REFERENCE TO RELATED APPLICATIONS

The present application claims priority to and benefit of U.S. Provisional Patent Application No. 63/165,665, filed Mar. 24, 2021, and entitled "ANTI-ROTATIONAL FUSE END CAP," the entirety of which is herein incorporated by reference.

FIELD

The present disclosure relates to the field of electrical fuses, and more particularly, to an end cap for an electrical fuse configured to prevent rotational displacement of the fuse relative to a mating adapter.

BACKGROUND

There are some types of electrical fuses which can be utilized with certain assemblies, including, for example, cutout assemblies, in which, in response to an overcurrent situation, an end of the fuse can be released from engagement with an electrical contact of the assembly. According to certain assemblies, adapters are secured to opposing ends of the fuse, and are used to secure the fuse to the assembly in at a position the electrically couples the fuse to electrical contacts of the assembly. Often such adapters include an upper adapter that can, in response to an overcurrent condition, be releasable from the assembly, and a lower adapter that can, upon release of the upper adapter from the assembly, accommodate pivotal displacement fuse relative to the assembly. Generally, securing the fuse to the assembly involves the adapters being at a particular alignment relative to each other such that features of the adapters can be received, or operably engaged, by corresponding mating features in the assembly.

SUMMARY

Some of the embodiments in the present disclosure are directed towards electrical fuses having various improvements over the types of electrical fuses that are generally available in the marketplace. The generally available electrical fuses require coupling the adapters to respectively corresponding ends of the fuse, which can result in inadvertent rotational and/or angular displacement of the fuse and another adapter that may already be coupled to the fuse. Such displacement can result in angular misalignment of the adapters, which can increase the difficultly, if not prevent, the fuse from being properly secured to the assembly. For example, such misalignment may result in one of the adapters not being able to be positioned and/or oriented to engage mating features of the assembly while the other adapter is secured to, or engaged with, corresponding mating features of the assembly. Some of the embodiments in the present disclosure provide electrical fuses to prevent inadvertent rotational displacement and associated misalignment of adapters that are coupled to the fuse.

According to some embodiments, a fuse assembly comprises a casing that can be positioned between a first end cap and a second end cap, the first end cap and the second end cap each being an electrical contact that is electrically coupled to a fuse element, the fuse element being housed at least within an interior region of the casing. The first end cap can include a recessed retention body that can be positioned along a wall of the first end cap. The recessed retention body can comprise a first retention wall, a second retention wall, and an engagement surface. The first retention wall and the second retention wall can extend at least in a generally outwardly direction from an adjacent portion of the retention surface to an outer surface of the wall, and also extend between a first end and a second end of the first end cap in a direction that is generally parallel to a central longitudinal axis of the fuse assembly. The engagement surface can comprise one or more walls that downwardly and outwardly extend in divergent directions from an apex of the engagement surface and toward the corresponding first or second retention wall. The apex can be positioned at a central location between the first and second retention walls, and extends in a direction that is generally parallel to the central longitudinal axis.

According to some embodiments, a fuse assembly comprises a casing positioned between a first end cap and a second end cap, the first end cap and the second end cap each being an electrical contact that is electrically coupled to a fuse element. The fuse element can be housed at least within an interior region of the casing. The first end cap can include a retention body that can be recessed into a wall of the first end cap. The recessed retention body can include a first body section comprising a first retention wall, a second retention wall, and an engagement surface. The first and second retention walls can extend at least in a generally outwardly direction from an adjacent portion of the retention surface to an outer surface of the wall, and also extend in a direction that is generally parallel to a central longitudinal axis of the fuse assembly from a first end of the first end cap to a shoulder section of the retention body that is positioned between the first end and a second end of the first end cap. The engagement surface can include one or more walls that downwardly and outwardly extend in divergent directions from an apex of the engagement surface and toward the corresponding first or second retention wall. Additionally, the apex can be positioned at a central location between the first and second retention walls, and can extend in a direction that is generally parallel to the central longitudinal axis. The recessed retention body can also include a second body section that can be positioned between the shoulder section and the second end of the first end cap. The second body section can have a pair of sidewalls and an indicator wall. The pair of sidewalls can extend at least in a generally outwardly direction from an adjacent portion of the indicator wall to the outer surface of the wall. Additionally, the indicator wall can be positioned between the pair of sidewalls and centrally aligned with the apex.

According to some embodiments, a fuse assembly is configured to be secured by a first adapter and a second adapter to a cutout body of a cutout assembly. The fuse assembly can include a casing positioned between a first end cap and a second end cap, the first end cap and the second end cap each being an electrical contact that is electrically coupled to a fuse element. The fuse element can be housed at least within an interior region of the casing. The first end cap can be configured to be secured within an interior region of the first adapter via at least a force applied against at least a portion of a recessed retention body of the first end cap by a shoe of a contact assembly of the first adapter. Further, the first end cap can have a length between a first end and a second end of the first end cap that is longer than a height of the interior region of the first adapter such that at least a portion of the first end cap extends outside the first adapter when the first adapter is secured to the first end cap. Additionally, the recessed retention body can include a first retention wall, a second retention wall, and an engagement surface. The first and second retention walls can be generally parallel to a central longitudinal axis of the fuse assembly and generally downwardly extend from an outer surface of the first end cap to an adjacent portion of the engagement surface. Further, a width between the first retention wall and the second retention wall can be similar to a corresponding width of the shoe. The first retention wall and the engagement surface can include one or more first descending walls or segments and one or more second descending walls or segments that downwardly and outwardly extend in divergent directions from opposing sides of an apex of the engagement surface. The apex can be positioned at a central location between the first and second retention walls and extends in a direction that is generally parallel to the central longitudinal axis. At least a portion of the recessed retention body can have a length between the first end and the second end of the first end cap that is larger than the height of the interior region of the first adapter.

DRAWINGS

Some embodiments of the disclosure are herein described, by way of example only, with reference to the accompanying drawings. With specific reference now to the drawings in detail, it is stressed that the embodiments shown are by way of example and for purposes of illustrative discussion of embodiments of the disclosure. In this regard, the description taken with the drawings makes apparent to those skilled in the art how embodiments of the disclosure may be practiced.

DETAILED DESCRIPTION

Figure 1:
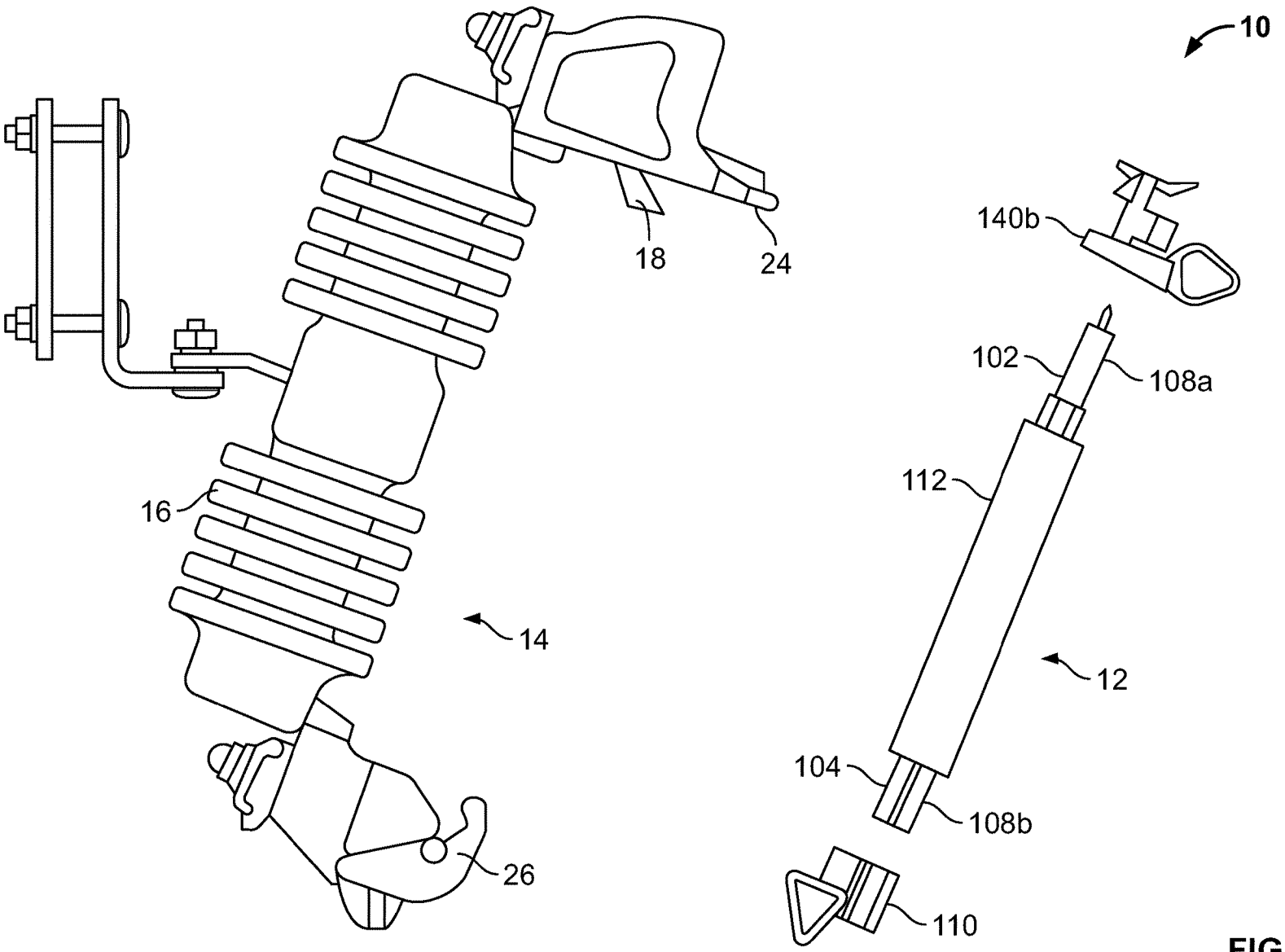
FIG. 1 illustrates a partially exploded side view of an exemplary fuse cutout assembly utilizing an exemplary fuse assembly according to some embodiments.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Further, when the language "at least a portion" and/or "a portion" is used the item may include a portion and/or the entire item unless specifically stated to the contrary.

As used herein, the term "between" does not necessarily require being disposed directly next to other elements. Generally, this term means a configuration where something is sandwiched by two or more other things. At the same time, the term "between" can describe something that is directly next to two opposing things. Accordingly, in any one or more of the embodiments disclosed herein, a particular structural component being disposed between two other structural elements can be:

disposed directly between both of the two other structural elements such that the particular structural component is in direct contact with both of the two other structural elements;

disposed directly next to only one of the two other structural elements such that the particular structural component is in direct contact with only one of the two other structural elements;

disposed indirectly next to only one of the two other structural elements such that the particular structural component is not in direct contact with only one of the two other structural elements, and there is another element which juxtaposes the particular structural component and the one of the two other structural elements;

disposed indirectly between both of the two other structural elements such that the particular structural component is not in direct contact with both of the two other structural elements, and other features can be disposed therebetween; or any combination(s) thereof.

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates a side view of an exemplary fuse cutout assembly 10 utilizing a fuse assembly 12 according to an illustrated embodiment of the present application. The fuse cutout assembly 10 can be utilized, for example, in connection with providing protection from at least current surges and overloads in high and medium voltage electric utility services, including, but not limited to, in electrical transmission systems and distribution systems operating at nominal voltages of about 3 kilovolts (kV) to about 38 kV, among other voltages and voltage ranges. In addition to the fuse assembly 12, the fuse cutout assembly 10 can include a cutout body 14 that supports the fuse assembly 12, and to which an insulator 16 is attached. The cutout body 14 can include an upper contact 18 and a lower contact 20 at opposing ends of the cutout body 14 that are positioned to be electrically coupled to first and second contacts 102, 104, respectively, of the fuse assembly 12. The upper contact 18 can be biased by a biasing element so as to provide a biasing force that at least attempts to maintain an engagement between the upper contact 18 of the cutout body 14 and the first contact 102 of the fuse assembly 12.

As seen in FIG. 1, when the fuse assembly 12 is supported by the cutout body 14, and the first contact 102 of the fuse assembly 12 is electrically coupled to the upper contact 18 of the cutout body 14, the cutout body 14 supports the fuse assembly 12 at an angle. With respect to at least some of the different types of fuses that can utilized with embodiments of the subject application, in response to an overcurrent condition, the fuse assembly 12 can be activated in a manner that can release a strike pin that is housed within the fuse assembly 12. The released strike pin can exert a force against, or in the general area, of the upper contact 18 in manner that can depress a portion of the cutout body 14 away from the fuse assembly 12, thereby facilitating physical and/or electrical disengagement between the first contact 102 of the fuse assembly 12 and the upper contact 18. In the event the fuse assembly 12 is to be disengaged from direct contact with the first contact 102 of the cutout body 14, the angle at which the fuse assembly 12 is supported by the cutout body 14 can allow gravitational forces to at least assist in the fuse assembly 12 being pivotally displaced about a lower cutout adapter 26 of the cutout body 14 such that the first contact 102 of the fuse assembly 12 is rotated away from the upper contact 18 of the cutout body 14.

The cutout body 14 can include an upper casting or adapter 106 that can be secured to, or about, an upper end 108*a* of the fuse assembly 12. The upper adapter 106 can be configured, including be sized and/or include features, that can engage mating features of the cutout body 14 in a manner that can secure the upper end 108*a* of the fuse assembly 12 to the cutout body 14, as well as accommodate the upper end 108*a* being released from the cutout body 14 in connection with the fuse assembly 12 responding to an overcurrent condition.

Figure 4:
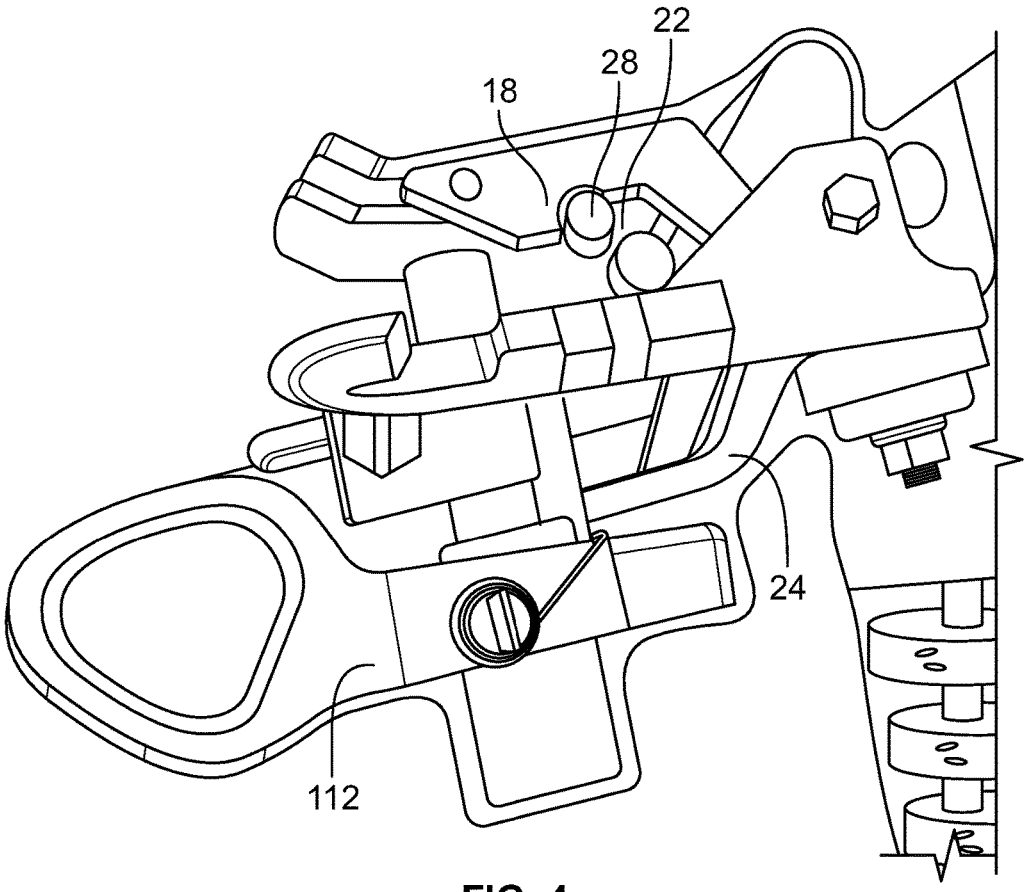
FIG. 4 illustrates a side perspective view of a portion of a fuse assembly coupled to an upper adapter that is securely engaged with a cutout body of a cutout assembly according to some embodiments.

For example, referencing FIGS. 1 and 4, according to at least some embodiments, the cutout body 14 can include an attachment hook 24 that can, when the upper adapter 106 is in proper alignment relative to at least the cutout body 14 and/or attachment hook 24, receive, and relatively securely engage, the upper adapter 106, and thus the upper end 108*a* of the fuse assembly 12, to the cutout body 14. Additionally, or alternatively, as seen in FIG. 4, according to certain embodiments, the cutout body 14 can include one or more openings or slots 22 (collectively referred to as openings) that can, when the upper adapter 106 is in proper alignment relative to at least the cutout body 14, receive one or more mating pins 28, which may or may not be coupled to the upper adapter 106. According to certain embodiments, such openings 22 can be configured and positioned so as to, in the absence of an overcurrent condition, securely retain engagement of the pins 28, and/or other features of the upper adapter 106 with the cutout body 14.

In the event of an overcurrent condition, the attachment hook 24 and/or openings 22 of the cutout body 14 can be displaced, such as, for example, in connection with a strike pin assembly of the fuse assembly 12 exerting a force against the cutout body 14 in a manner that lifts or otherwise displaces the hook 24 and/or openings 22, among other portions of the cutout body 14, in a direction that can facilitate disengagement or release of the upper adapter 106, and/or associated features of the upper adapter 106, from the hook 24 and/or the associated openings 22.

As seen in FIG. 1, the cutout body 14 can also include a lower cutout bracket or adapter 26 that can be pivotally coupled to a lower casting or adapter 110 that is secured to a lower end 108*b* of the fuse assembly 12. As seen in at least FIG. 3A, the lower adapter 110 can include a wall 124 having an inner surface 126 that generally defines an interior region 128 of the lower adapter 110 that is configured to receive insertion of at least a portion of the lower end 108*b* of the fuse assembly 12, such as, for example, at least a portion of an end cap 130 (FIGS. 7-20), such as, for example, the lower end cap 114*b* of the fuse assembly 12. According to certain embodiments, the inner surface 126 can have a generally circular cross-sectional shape.

Figure 3B:
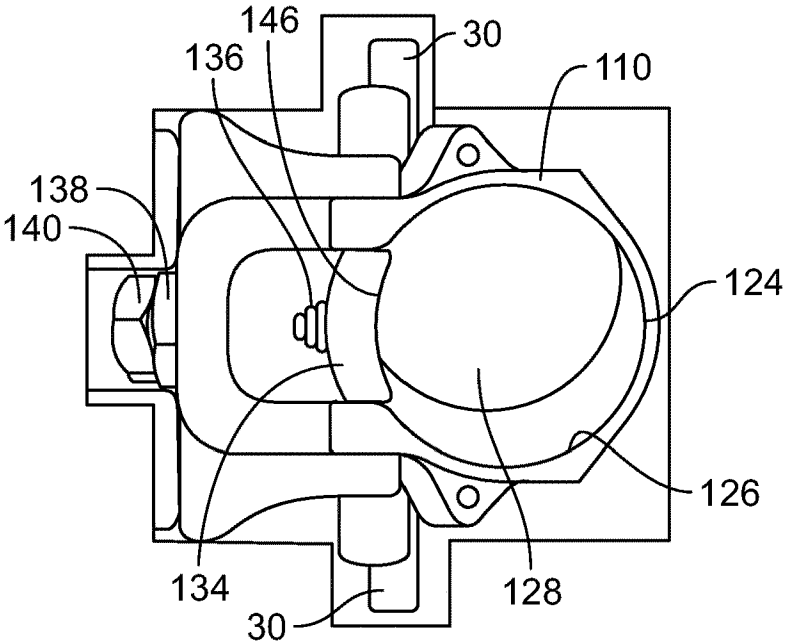
FIG. 3B illustrates a top side view of an exemplary lower casting or adapter according to some embodiments.
Figure 3A:
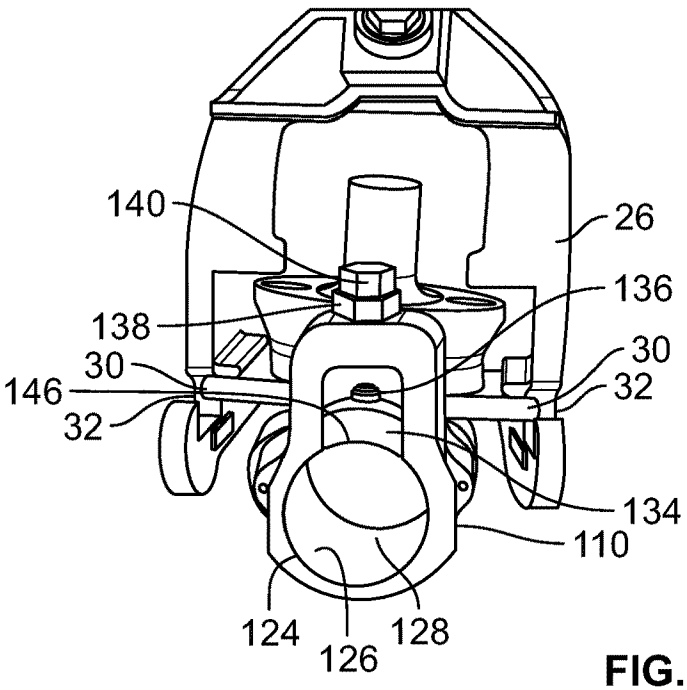
FIG. 3A illustrates a top side perspective view of an exemplary lower casting or adapter coupled to a portion of a cutout body of a cutout assembly according to some embodiments.

The lower adapter 26 of the cutout body 14 and the lower adapter 110 that is secured to the fuse assembly 12, can be configured to secure the lower end 108*b* of the fuse assembly 12 to the cutout body 14. In the event the fuse assembly 12 responds to an overcurrent condition, such as, for example, releasing a strike pin assembly of the fuse assembly 12 that facilitates the release of the upper adapter 106 from the cutout body 14, as discussed above, the lower adapter 110 is further configured to accommodate rotational displacement of the fuse assembly 12 while the lower adapter 110 remains attached to the cutout body 14. For example, as seen in at least FIG. 3B, the lower adapter 110 can include a pair of pins 30 that are positioned on opposing sides of the lower adapter 110. The pins 30 of the lower adapter 110 can each, when properly aligned with the lower adapter 26 of the cutout body 14, be received in a mating opening or slot 32 (collectively referred to as openings 32) in the lower adapter 26 of the cutout body 14, as seen in FIG. 3A. Additionally, the pins 30 of the lower adapter 110 and mating openings 32 in the lower adapter 26 of the cutout body 14 can be sized such that, when the pins 30 are positioned in the openings 32, the lower adapter 110 can be pivotally displaceable relative to at least the cutout body 14.

Often, both the upper adapter 106 and lower adapter 110 are secured to, or about, the corresponding upper or lower end 108*a*, 108*b*, respectively, of the fuse assembly 12 prior to either of the upper adapter 106 or lower adapter 110 being coupled to the cutout body 14. Further, when secured to the fuse assembly 12, misalignment between the upper and lower adapters 106, 110 can result in one, but not both, of the upper and lower adapters 106, 110 being able to securely engage the mating features in the cutout body 14. For example, in such a situation, when the pins 30 of the lower adapter 110 are positioned to be, or have been, received in the mating openings 32 in the lower adapter 26 the cutout body 14, the upper adapter 106 can be attached to the upper end 108*a* of the fuse assembly 12 at an angular orientation that prevents the upper adapter 106, and/or associated features of the upper adapter 106, from being matingly received by the hook 24 and/or mating openings 22, among other features, of the cutout body 14.

Such misalignment between at least the upper and lower adapters 106, 110 can occur in a variety of manners. For example, in at least some instances when the upper adapter 106 is secured to the upper end 108*a* of the fuse assembly 12, such misalignment may result from the rotation of the fuse assembly 12 that can occur when the lower adapter 110 is being mechanically coupled to the lower end 108*b* of the fuse assembly 12. For example, referencing FIGS. 3A, 3B, 5, and 6, according to certain embodiments, the lower adapter 110 can include a contact assembly 132 that provides at least a force against an end cap 130 of the fuse assembly 12 that securely clamp or couples the lower adapter 110 to the end cap 130 of the fuse assembly 12. In at least some instances, the location at which the contact assembly 132 at least initially contacts the end cap 130, and/or the ensuing application of force against the end cap 130 by the contact assembly 132 can result in inadvertent rotational displacement of the fuse assembly 12 within the end cap 130, thereby rotating both the fuse assembly 12 and the upper adapter 106 in a manner that can result in misalignment between the upper and lower adapters 106, 110. As previously discussed, such misalignment can, in at least some instances, interfere and/or prevent the fuse assembly 12 from being secured at both ends the fuse assembly 12 to the cutout body 14.

Figure 2:
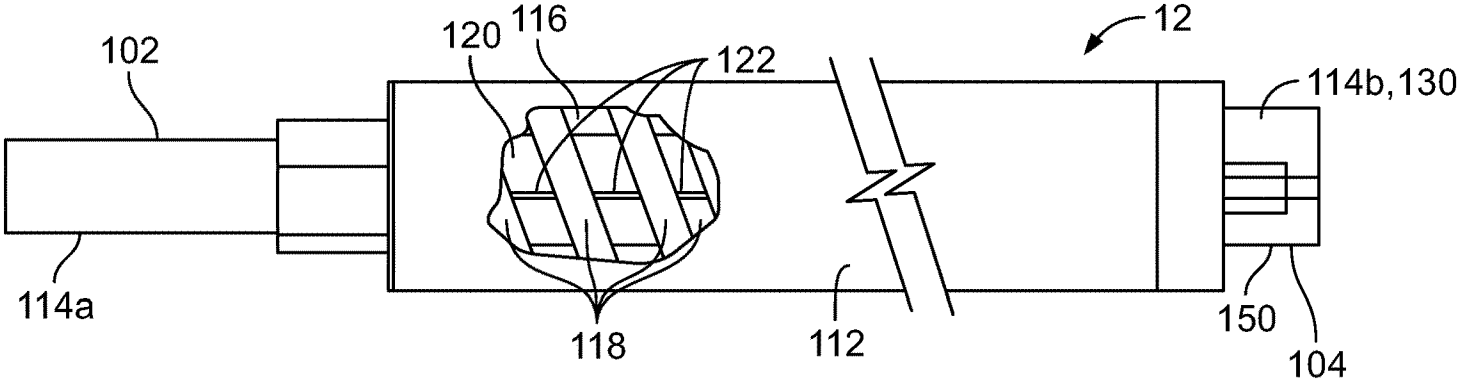
FIG. 2 illustrates a partial cutaway side view of an exemplary fuse assembly according to some embodiments.

FIG. 2 illustrates a partial cut away side view of an exemplary fuse assembly 12 according to an illustrated embodiment of the present application. As seen, the fuse assembly 12 includes a casing 112 that is positioned between a first end cap 114 and second end cap 114*a* that are located at opposing ends of the fuse assembly 12. According to the illustrated embodiment, the first and second end caps 114*a*, 114*b* can provide the first and second contacts 102, 104, respectively, of the fuse assembly 12. Thus, the ends caps 114*a*, 114*b* can be constructed from a metallically conductive material, such as, for example, but not limited to, brass, copper, silver, and/or tin, among other materials, as well as various combinations thereof. Additionally, as mentioned above with respect to FIG. 1, at least the second end cap 114*b* can include features relating to the various end cap 130 embodiments that discussed below with respect to FIGS. 7-20. The casing 112 can be constructed from a variety of materials, and more specifically, electrically insulating materials. For example, according to certain embodiments, the casing 112 can be constructed from a ceramic material.

As seen by the cutaway portion of FIG. 2, the casing 112 can generally define an interior region 116 of the fuse assembly 12 that can extend along the casing 112 between the opposing end caps 114*a*, 114*b*, and which can house one or more components of the fuse assembly 12, as well as insulating and/or arc preventing material(s), such as, for example, sand. For example, as seen in FIG. 2, the interior region 116 can house one or more fuse elements 118. The fuse element 118 is electrically coupled to the first and second contacts 102, 104 of the fuse assembly 12, and can be constructed from a variety of materials, including, but not limited to, tin, lead, silver, copper, zinc or brass, among other materials or combinations of materials. As seen in FIG. 2, according to the exemplary embodiment, the fuse element 118 is generally wrapped about a support element or core 120 that can be constructed from an electrically insulative material. However, the fuse element 118 can be arranged within the interior region 116 of the casing 112 in a variety of other manners, including having a generally linear orientation. Further, according to certain embodiments, at least a portion of the fuse element 118 can be encased or wrapped in an elastomeric material, such as, for example, silicon rubber.

According to an exemplary embodiment, the interior region 116 can also house a wire or filament 122 that is coupled to a strike pin assembly of the fuse assembly 12. At least prior to activation of a strike pin assembly of the fuse assembly 12, the filament 122 can be maintained in a relatively taut condition such that filament 122 can provide a holding force against at least a portion of the strike pin assembly that can at least assist in preventing activation of the strike pin assembly. In the event of a current surge or other overload condition, the degree of current flowing through the fuse element 118 can result in the fuse element 118 generating heat, and/or cause gases within the interior region to be heated, to levels that can heat the filament 122 to a degree that can cause a break(s) or separation(s) in the filament 122. Such breakage(s) in the filament 122 can release the holding force that the filament 122 had providing against the strike pin assembly, thereby allowing for activation of the strike pin assembly. While the foregoing is discussed with respect to a use of a wire or filament, according to other embodiments of the subject application, other devices, mechanisms, and/or methods can be used to trigger the release of a strike pin of the fuse assembly 12. Moreover, in addition to the above-discussed exemplary fuse, embodiments of the subject application can also be used with a variety of other, or different, types of fuse assemblies.

Figure 5:
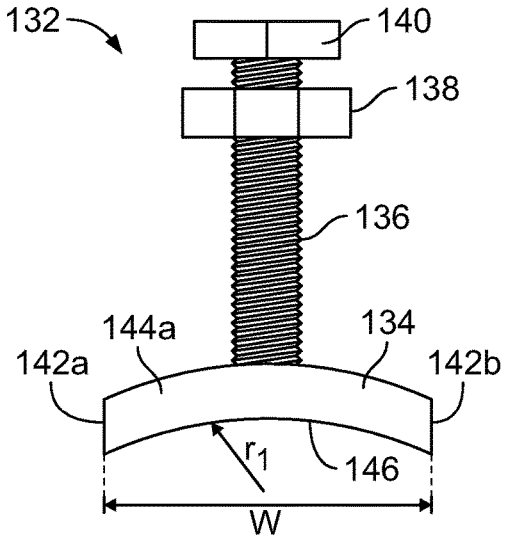
FIGS. 5 and 6 illustrate top and side views, respectively, of an exemplary contact assembly for use with the lower casting or adapter shown in FIGS. 3A and 3B according to some embodiments.
Figure 6:
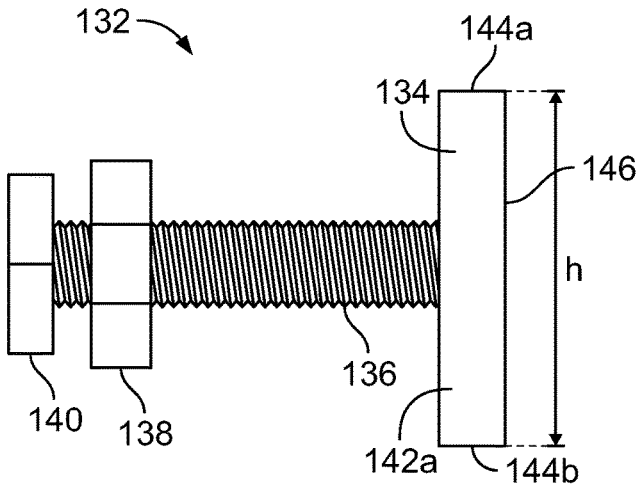

Referencing FIGS. 5 and 6, according to certain embodiments, the contact assembly 132 of the lower adapter 110 can include a clamping plate or shoe 134, a bolt 136, and a nut 138. The wall 124 of the lower adapter 110 can include an opening through which at least a portion of the shoe 134 can be selectively displaced into a portion of the interior region 128 of the lower adapter 110 and/or displaced into contact with an adjacent portion of the end cap 130 that is generally positioned within the interior region 128 of the lower adapter 110. The wall 124 of the lower adapter 110 can also include an aperture through which a portion of the bolt 136 can pass through, or around, the wall 124. Such an aperture, which may or may not include an internal thread for threaded engagement with the bolt 136, can be sized to accommodate both rotational and linear displacement of the bolt 136.

A first end of the bolt 136 can be secured to the shoe 134 such that the bolt 136 can be rotated relative to at least the shoe 134. A second end of the bolt 136 can include a head 140, such as, for example, a hexagonally shaped head that is sized for engagement with a tool, including, for example, a wrench and/or socket. The bolt 136 can also include a threaded region positioned between the first end and a second end of the bolt 136 that is configured for threaded engagement with at least the nut 138. The head 140 of the bolt 136 and the shoe 134 can be positioned on opposing sides of the wall 124, while the bolt 136 may, or may not, be positioned on the same side of the wall 124 as the head 140 of the bolt 136.

Rotational displacement of the bolt 136 can facilitate linear displacement of the bolt 136 and the shoe 134, thereby linearly displacing the shoe 134 toward and/or at least partially into, or away, from the interior region 128 of the lower adapter 110, and thus either toward or away from an adjacent portion of the end cap 130 of the fuse assembly 12 that is positioned within the interior region 128. The direction of such linear displacement of the shoe 134 can depend on the direction at which the bolt 136 is being rotatably displaced. Further, depending on the direction and degree of displacement of the shoe 134, such displacement of the shoe 134 can be utilized to exert a force against the end cap 130 of the fuse assembly 12 that clamps, or otherwise secures, the lower adapter 110 to the fuse assembly 12, or, alternatively, to release such a force from the end cap 130.

As seen in FIGS. 5 and 6, the shoe 134 can have a width (as generally indicated by "w" in FIG. 5) between opposing first and second sidewalls 142*a*, 142*b* of the shoe 134, as well as a height (as generally indicated by "h" in FIG. 6) between opposing top and bottom walls 144*a*, 144*b* of the shoe 134. As seen in FIG. 5, the shoe 134 includes an inner wall 146 that is configured to engage an adjacent surface of the end cap 130 when the end cap 130 is positioned within the interior region 128 of the lower adapter 110. According to certain embodiments, the inner wall 146 can have concave configuration as the inner wall 146 extends between the first and second sidewalls 142*a*, 142*b* of the shoe 134. Such a configuration can provide the inner wall 146 of the shoe 134 with an inwardly extending arc shape or curvature that extends along a radius (as indicated by "n" in FIG. 5). According to certain embodiments, such a radius can be the same as, or generally similar to, the radius of the inner surface 126 of the wall 124 of the lower adapter 110, and/or corresponds to a radius or non-rounded configuration of the portion of the end cap 130 that is received into the interior region 128 of the lower adapter 110 and to which the shoe 134 is to engage.

Figure 7:
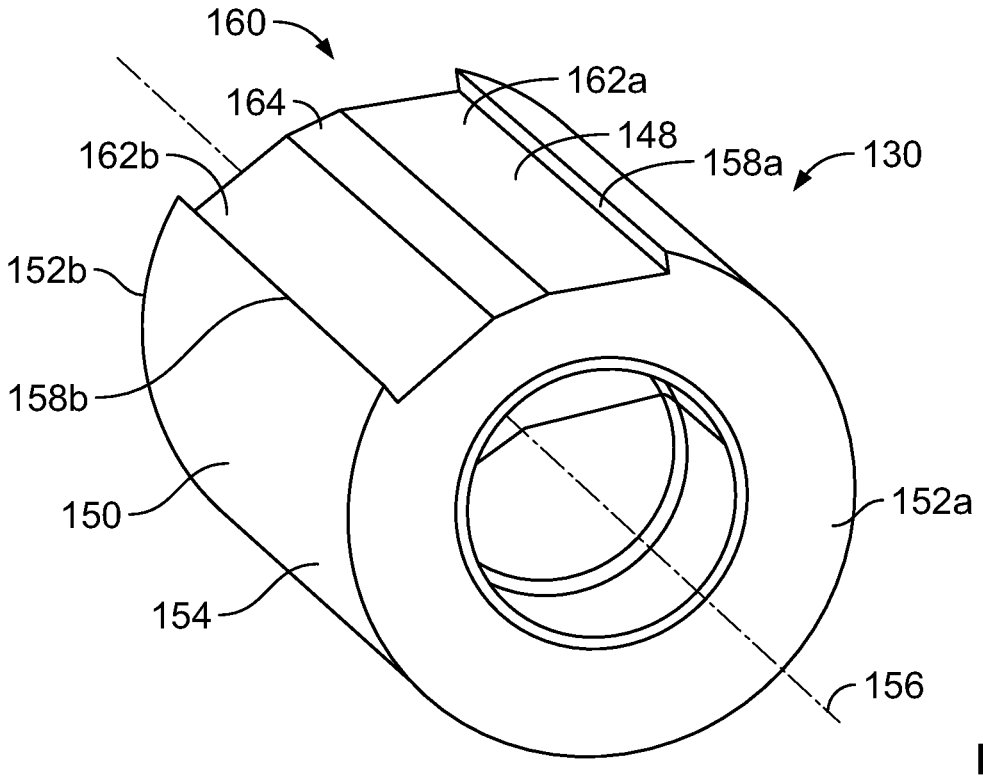
FIGS. 7 and 8 illustrate a front side perspective view and a bottom view, respectively, of an exemplary recessed retention body for an end cap of a fuse assembly according to according to some embodiments.
Figure 8:
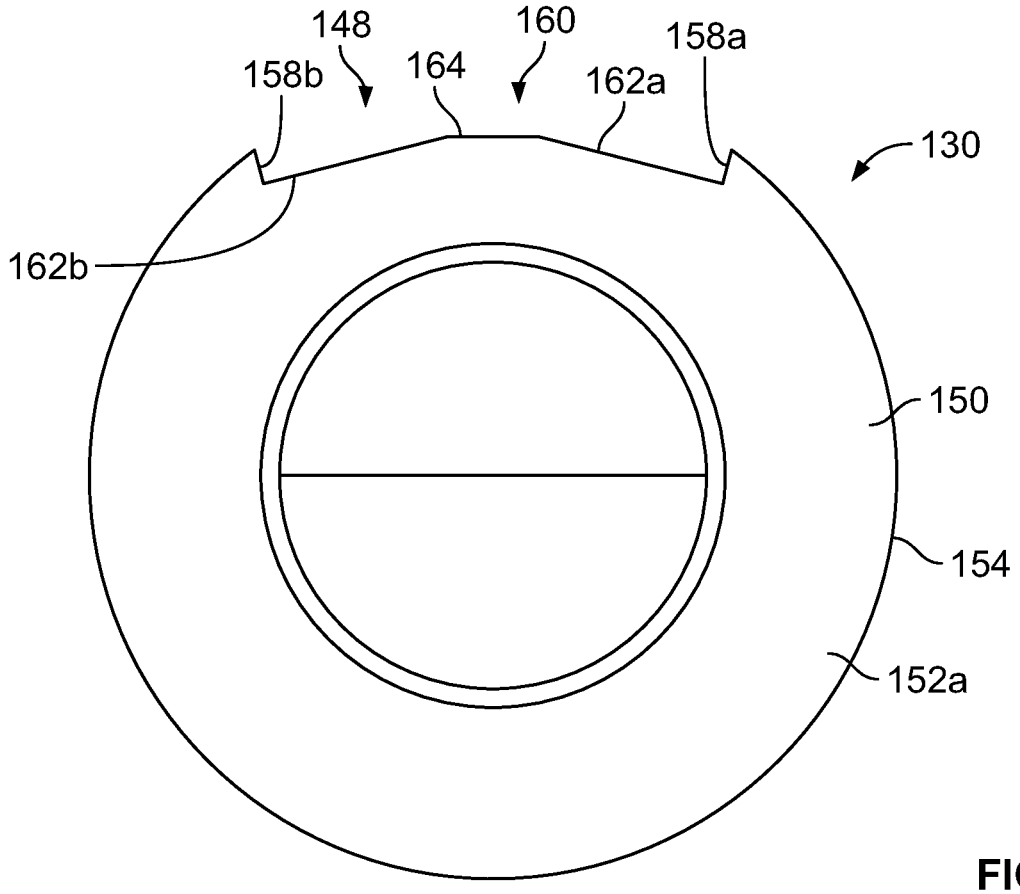

Referencing FIGS. 7 and 8, the end cap 130 of the fuse assembly 12 that is placed within the interior region 128 of the lower adapter 110 can include a recessed retention body 148 in a wall 150 of the end cap 130. As seen, the wall 150 of the end cap 130 extends between opposing first and second ends 152*a*, 152*b* of the end cap 130. The second end 152*b* of the end cap 130 can provide an end of the fuse assembly 12, while the first end 152*a* is positioned between the second end 152*b* and the casing 112 of the fuse assembly 12. According to certain embodiments, the first end 152*a* of the end cap 130 can be generally adjacent to the casing 112. The wall 150 also includes an outer surface 154, at least a portion of which is configured to be received in the interior region 128 of the lower adapter 110. The outer surface 154 can have a size, such as, for example, a diameter or cross-sectional length, that can be similar to, if not slightly smaller than, a corresponding size, such as, for example, diameter, of the interior region 128 of the lower adapter 110. Thus, while the outer surface 154 of the wall 150 of the end cap 130 is illustrated as having a circular cross-sectional shape, the outer surface 154 can have a variety of other shapes, including, for example, hexagonal, among other polygons.

The recessed retention body 148 of the end cap 130 is configured and positioned for engagement with at least a portion of the inner wall 146 of the shoe 134. Moreover, the retention body 148 is configured to engage, as well as be positioned about, at least portions of the shoe 134 in a manner that can increase the surface area of the end cap 130 that is in contact with the inner wall 146 of the shoe 134, and/or prevent inadvertent rotational displacement of the end cap 130, and thus of the fuse assembly 12. Such a configuration can allow the retention body 148 to, when engaged, and/or being engaged, with the shoe 134, prevent or minimize inadvertent rotational displacement of at least the end cap 130 and fuse assembly 12 about a central longitudinal axis 156 of the end cap 130, and thus of the fuse assembly 12. Moreover, the recessed retention body 148 is configured to prevent and/or minimize inadvertent rotational displacement of the end cap 130, and thus fuse assembly 12, as the shoe 134 is being linearly displaced into contact with the end cap 130 and/or while the shoe 134 is being displaced in a manner that increases the force that is being exerted against the end cap 130 by at least the shoe 134.

According to certain embodiments, the recessed retention body 148 includes retention walls 158*a*, 158*b* that upwardly and/or outwardly extend from an adjacent portion of an engagement surface 160 of the retention body 148 to the outer surface 154 of the wall 150. Thus, each retention wall 158*a*, 158*b* can have a size, such as, for example, length or height, between an adjacent portion of the engagement surface 160 and the outer surface 154 of the wall 150 of the end cap 130. Such a length or height of the retention walls 158*a*, 158*b* can allow the retention walls 158*a*, 158*b* to be configured to abut an adjacent sidewall 142*a*, 142*b* of the shoe 134 in a manner that can provide a barrier that can prevent rotational displacement of the end cap 130, and thus the fuse assembly 12, along the central longitudinal axis 156 of the end cap 130 while the retention body 148 is receiving the shoe 134 and/or while the shoe 134 is being displaced in a manner in which the shoe 134 is exerting a force against the engagement surface 160 of the retention body 148.

The retention walls 158*a*, 158*b* can generally upwardly and/or outwardly extend from an adjacent portion of an engagement surface 160 of the retention body 148 to the outer surface 154 of the wall 150 in a manner that may, or may not, result in the retention walls 158*a*, 158*b* being parallel to each other. For example, as shown by the profiles of the retention walls 158*a*, 158*b* illustrated in FIG. 8, according to certain embodiments, the retention walls 158*a*, 158*b* can generally upwardly and/or outwardly extend in divergent directions from a corresponding adjacent portion of an engagement surface 160 of the retention body 148 to the outer wall 150 of the end cap 130. However, the retention walls 158*a*, 158*b* can have a variety of other profiles, including, for example, profiles in which the retention walls 158*a*, 158*b* are parallel to each other.

Additionally, the retention walls 158*a*, 158*b* can extend at least along a portion of a length of the end cap 130 in a direction between the first and second ends 152*a*, 152*b* of the end cap 130. For example, as shown in FIG. 7, according to certain embodiments, the retention walls 158*a*, 158*b* can extend from the first end 152*a* to the second end 152*b* of the end cap 130 in a direction that is generally parallel to the central longitudinal axis 156 of the end cap 130. Thus, according to such an embodiment, in addition to being parallel to the central longitudinal axis 156 of the end cap 130, the retention walls 158*a*, 158*b* can be generally parallel to each other along the length of the end cap 130. However, the retention walls 158*a*, 158*b* can extend in other directions so as to conform to the orientation of the first and second sidewalls 142*a*, 142*b* of the shoe 134 that are to be positioned generally adjacent to the retention walls 158*a*, 158*b* at least when the inner wall 146 shoe 134 is engaged with the engagement surface 160 of the retention body 148.

According to certain embodiment, the retention body 148 can have a width that extends between the retention walls 158*a*, 158*b* that is similar to, if not slightly larger, than a corresponding width ("w") of the shoe 134, as discussed above with respect to FIG. 5. Moreover, such similarities between the widths of the retention body 148 between the retention walls 158*a*, 158*b* and width of the shoe 134 between the sidewalls 142*a*, 142*b* of the shoe 134 can result in the sidewalls 142*a*, 142*b* of the shoe 134 being in relatively close proximity to, and/or abutment with, adjacent portions of the associated retention wall 158*a*, 158*b*. Such similarities in widths of the retention body 148 and the shoe 134, along with the barrier provided by the height or length of retention walls 158*a*, 158*b* between the outer surface 154 of the wall 150 and the engagement surface 160, can further assist in preventing and/or minimizing inadvertent rotational displacement of the end cap 130, and thus the fuse assembly 12, that may be associated with the shoe 134 exerting a force against the end cap 130 at least when the inner wall 146 of the shoe 134 is engaged with the engagement surface 160 of the retention body 148.

The engagement surface 160 of the retention body 148 can have a variety of different configurations. For example, according to the embodiment shown in FIGS. 7 and 8, the engagement surface 160 can comprise first and second descending walls or segments 162*a*, 162*b* that downwardly and outwardly extend in divergent directions from opposing sides of an apex wall or segment 164 that is generally positioned along at least a midsection of the engagement surface 160. According to the illustrated embodiments, each of the first and second descending walls or segments 162*a*, 162*b* and apex wall or segment 164 are generally flat surfaces that are non-planar with each other, and are in arranged in a manner that generally provides the engagement surface 160 with a segmented convex or arc shaped surface. Thus, for example, according to the illustrated embodiment, the first and second descending walls or segments 162*a*, 162*b* may each be joined to the apex wall or segment 164 at an angle that is less than 180 degrees.

Figure 10:
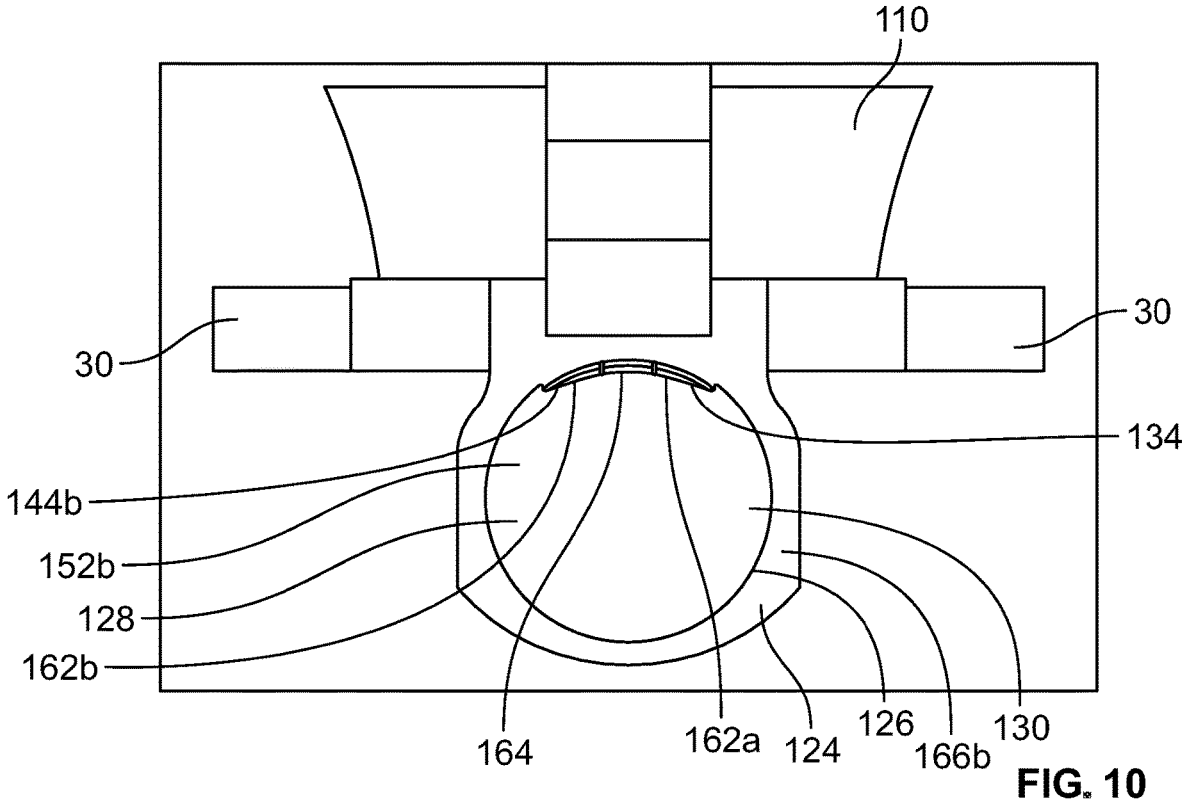
Figure 11:
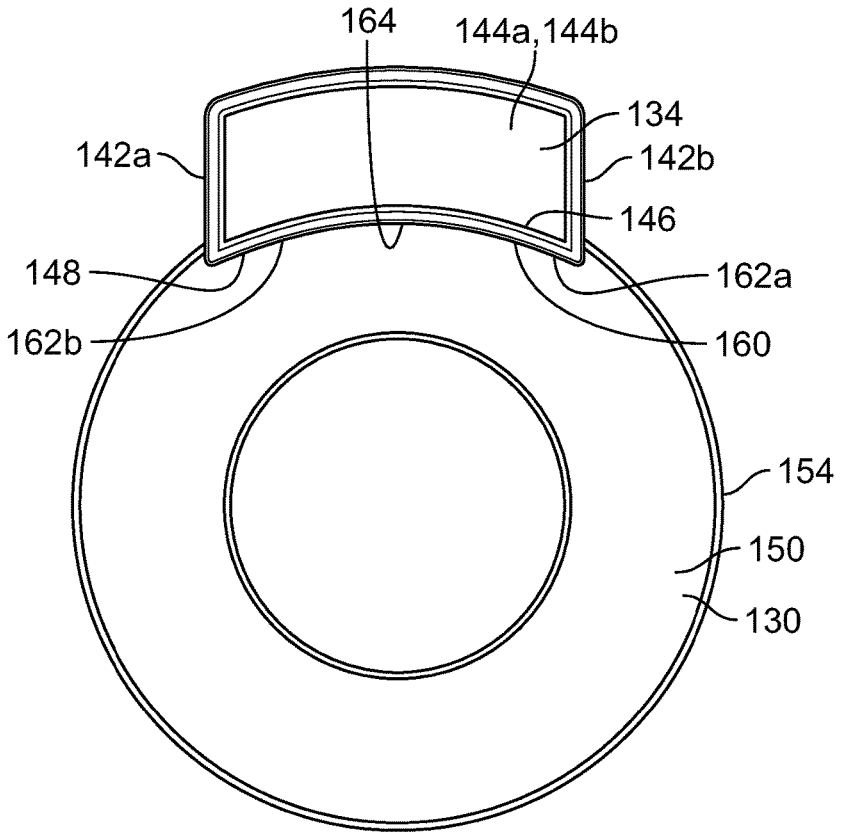
FIG. 11 illustrates a bottom view of a shoe of the contact assembly shown in FIGS. 5 and 6 engaged with the recessed retention body shown in FIG. 7 according to some embodiments.
Figure 12:
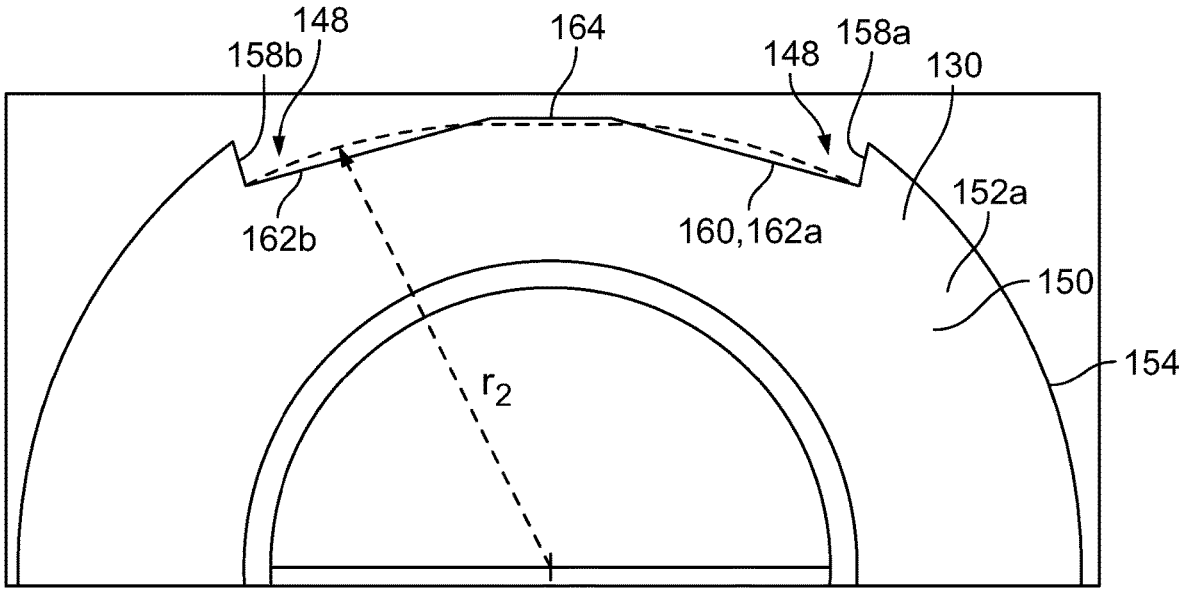
FIG. 12 illustrates another bottom view of the recessed retention body shown in FIG. 8 with and an indication of an exemplary mating arc having a radius corresponding to a radius of an inner wall of an exemplary shoe according to some embodiments.

Referencing FIGS. 10-12, the degree at which the first and second descending walls or segments 162*a*, 162*b* can each be joined to the apex wall or segment 164 can be based on a variety of different factors. For example, as indicated in FIGS. 10 and 11, the engagement surface 160 of the retention body 148 can be configured to generally conform to the shape of the opposing inner surface of the shoe 134. Thus, as illustrated in FIG. 12, according to certain embodiments in which the inner wall 146 of the shoe 134 has an inwardly curved or concave configuration, the first and second descending walls or segments 162*a*, 162*b* and apex wall or segment 164 of the engagement surface 160 can be configured and arranged in a manner that at least attempts to generally form and/or generally follow along, a outwardly curved or convex shape that is generally arranged along a radius (as indicated by "n" in FIG. 12). According to the embodiment depicted in FIGS. 7 and 8, the radius (n) utilized for configuring the segmented arrangement of the engagement surface 160 can be generally the same as, or similar to, the radius ("n") of the inner wall 146 of the shoe 134, as discussed above with respect to FIG. 5, and/or a radius of the inner surface 126 that generally defines the interior region 128 of the lower adapter 110.

As discussed above, the retention body 148 can have a length between the first and second ends 152*a*, 152*b* of the end cap 130 in a direction that is generally parallel to the central longitudinal axis 156 of the end cap 130. Such length of the retention body 148 can, for example, result in the retention body 148 extending from the first end 152*a* to the second end 152*b* of the end cap 130, as illustrated, for example, by the embodiment depicted in at least FIG. 7. According to other embodiments, such a configuration can result in the retention body 148 extending from one of the first and second ends 152*a*, 152*b* of the end cap 130 but not reaching the other of the first and second ends 152*a*, 152*b*, as illustrated, for example, by the embodiment depicted in at least FIG. 17. Alternatively, such a configuration can result in a portion of the retention body 148 extending from the first end 152*a* to the second end 152*b*, while another portion of the retention body 148 extends from one of the first and second ends 152*a*, 152*b* of the end cap 130 but does not reach the other of the first and second ends 152*a*, 152*b*, as illustrated, for example, by the embodiment depicted in at least FIG. 14.

Figure 9:
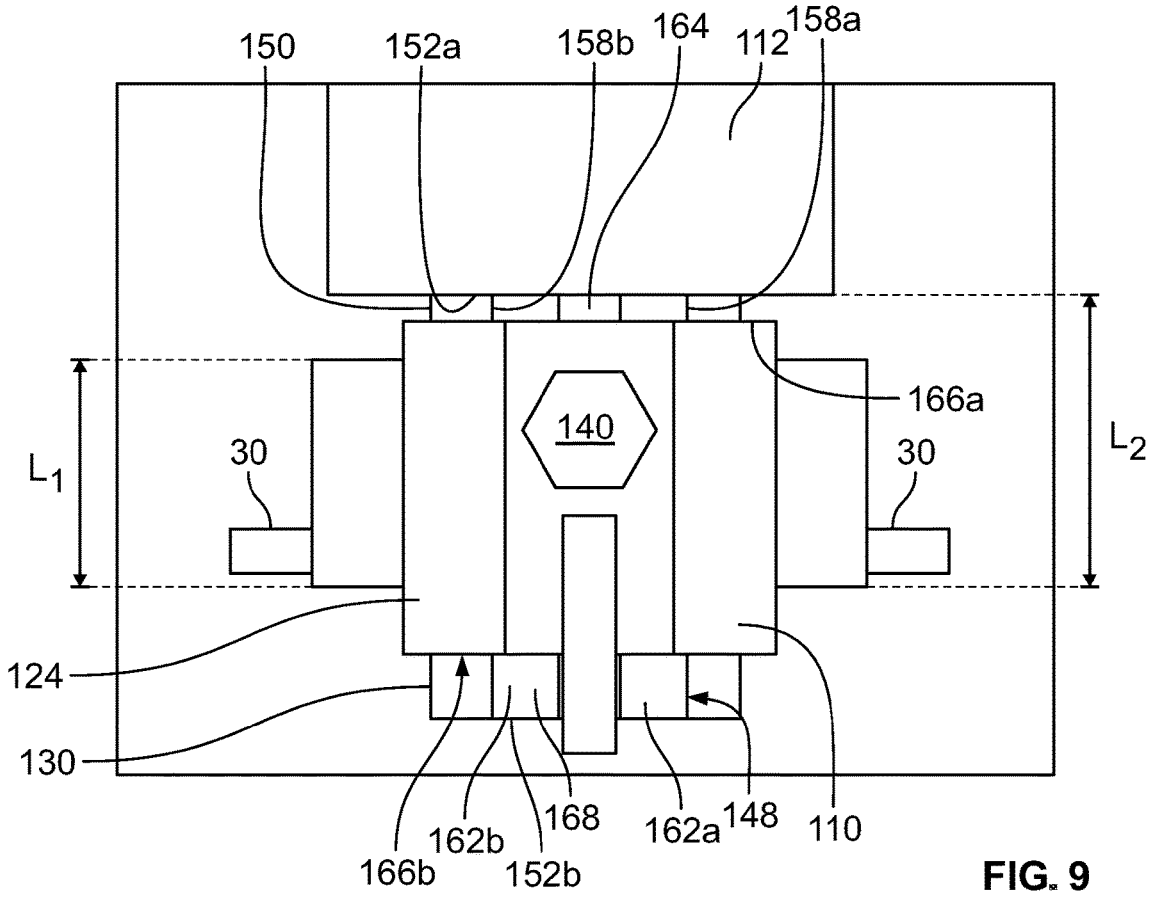
FIGS. 9 and 10 illustrate a front side view and a bottom view, respectively, of the recessed retention body of the end cap shown in FIGS. 7 and 8 positioned within an exemplary lower casting or adapter and engaged with a mechanical contact assembly according to some embodiments.

As illustrated in FIG. 9, the length of the end cap 130 between the first and second ends 152*a*, 152*b* of the end cap 130 can have a length (as generally indicated by "L2" in FIG. 9) that is longer than a corresponding length (as generally indicated by "L1" in FIG. 9) between at least the upper and lower surfaces 166*a*, 166*b* of the wall 124 of the lower adapter 110. Thus, when the end cap 130 is positioned and/or secured within the interior region 128 of the lower adapter 110, at least a portion of the end cap 130 can at least protrude from either, or both, of the upper and lower surfaces 166*a*, 166*b* of wall 124 of the lower adapter 110 and/or from the interior region 128 of the lower adapter 110.

Such protruding portion(s) of the end cap 130 can be visible to the individual or installer that is securing, or has secured, the lower adapter 110 to the end cap 130 via use of shoe 134 of the contact assembly 132. Thus, according to embodiments in which the length of the retention body 148 in a direction generally parallel to the central longitudinal axis 156 is larger than a corresponding length ("L1") of the lower adapter 110, a portion of retention body 148 can visible along at least a portion of the end cap 130 that protrudes out from the interior region 128 of the lower adapter 110. For example, as seen in FIG. 9, as the retention body 148 extends the entire length of the end cap 130, and the length of the end cap 130 is larger than a corresponding length of the wall 124 of the lower adapter 110, at least a portion of the retention body 148 is visible along portions of the end cap 130 that protrude out from the interior region 128, and/or protrude above and/or below the upper and lower surfaces 166*a*, 166*b*, respectively, of wall 124 of the lower adapter 110.

The visually accessible portion(s) of retention body 148 that can be seen along the portion(s) of the end cap 130 that protrude away from the wall 124 of the lower adapter 110 can provide the end cap 110 with a first visual indicator 168 that can indicate to the installer the angular orientation of the retention body 148 relative to at least the shoe 134. Moreover, such a first visual indicator 168 can provide the installer with an indication of the current alignment, or misalignment, of the retention body 148 relative to at least the shoe 134 and/or the lower adapter 110, and thus the fuse assembly 12 relative to the lower adapter 110. According to certain embodiments, the installer can use a central location of the first visual indicator 168 relative to the shoe 134, bolt 136, nut 138 and/or head 140 to evaluate whether the shoe 134 and end cap 130 are properly aligned with respect to relative angular positions, or if the shoe 134 is at a position that is angularly offset relative to corresponding angular position of the retention body 148 in a manner that can cause misalignment between the lower adapter 110 and the upper adapter 106, which may be secured to the opposing ends 108*a* of the fuse assembly 12. Based on such an evaluation using the first visual indicator 168, the installer can determine, at least prior to attempting to secure the upper and lower adapters 106, 110, and thus the fuse assembly 12, to the cutout body 14, whether the angular orientation of the end cap 130 relative to the shoe 134 and/or lower adapter 130 should be adjusted.

Figure 13:
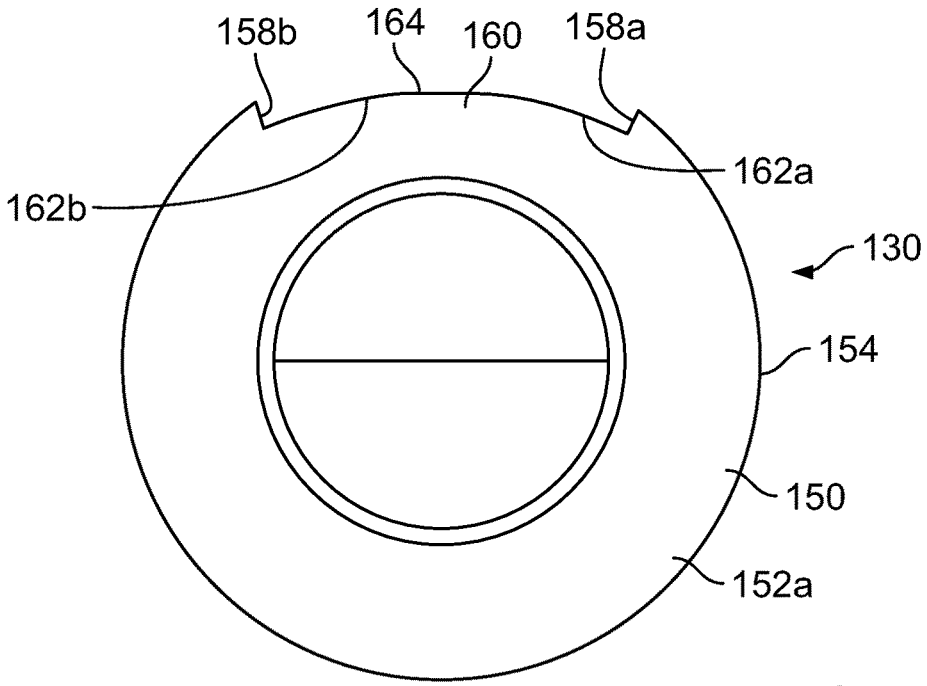
FIG. 13 illustrates a bottom view of an exemplary recessed retention body for an end cap of a fuse assembly according to some embodiments.

While the embodiment illustrated in at least FIGS. 7 and 8 depicts the first descending wall or segment 162*a*, the second descending wall or segment 162*b*, and the apex wall or segment 164 as each comprising a single surface, wall, or segment, according to other embodiments, the first descending wall or segment 162*a*, the second descending wall or segment 162*b*, and/or the apex wall or segment 164 can comprise one or more walls or segments. For example, according to certain embodiments, the first descending wall or segment 162*a*, the second descending wall or segment 162*b*, and/or the apex wall or segment 164 can comprise a plurality of walls or segments that can be non-planar to adjacent adjoining walls or segments of the associated plurality of walls or segments, as well extend from the adjacent adjoining walls or segments of the associated plurality of walls or segments at an angle that is less than 180 degrees. Further, such a plurality of walls or segments for the first descending wall or segment 162*a*, the second descending wall or segment 162*b*, and/or the apex wall or segment 164 can enhance the ability of the engagement surface 160 to conform to the inwardly curved shape of the inner wall 146 of the shoe 134. For example, FIG. 13 illustrates an embodiment in which each of the first descending wall or segment 162*a*, the second descending wall or segment 162*b*, and/or the apex wall or segment 164 comprise a plurality of relatively small walls or segments that extend in manners relative to adjacent walls or segments that may further emulate the engagement surface 160 having an outwardly curved or convex configuration that is configured to matingly engage at least portions of the inwardly curved inner wall 146 of the shoe 134. Alternatively, according to other embodiments, the engagement surface 160 can be formed as a generally continuous curved or rounded surface.

Figure 14:
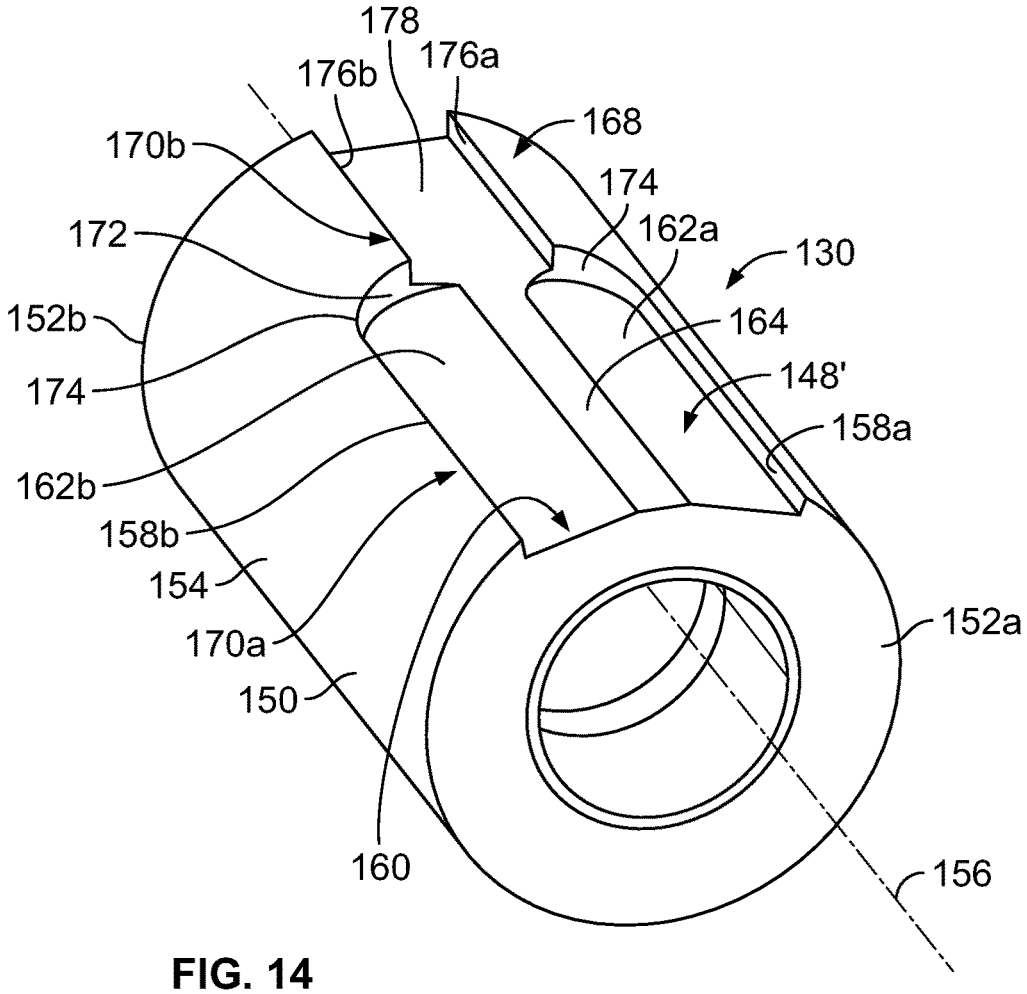
FIGS. 14 and 15 illustrate a front side perspective view and a bottom view, respectively, of an exemplary recessed retention body for an end cap of a fuse assembly according to some embodiments.
Figure 15:
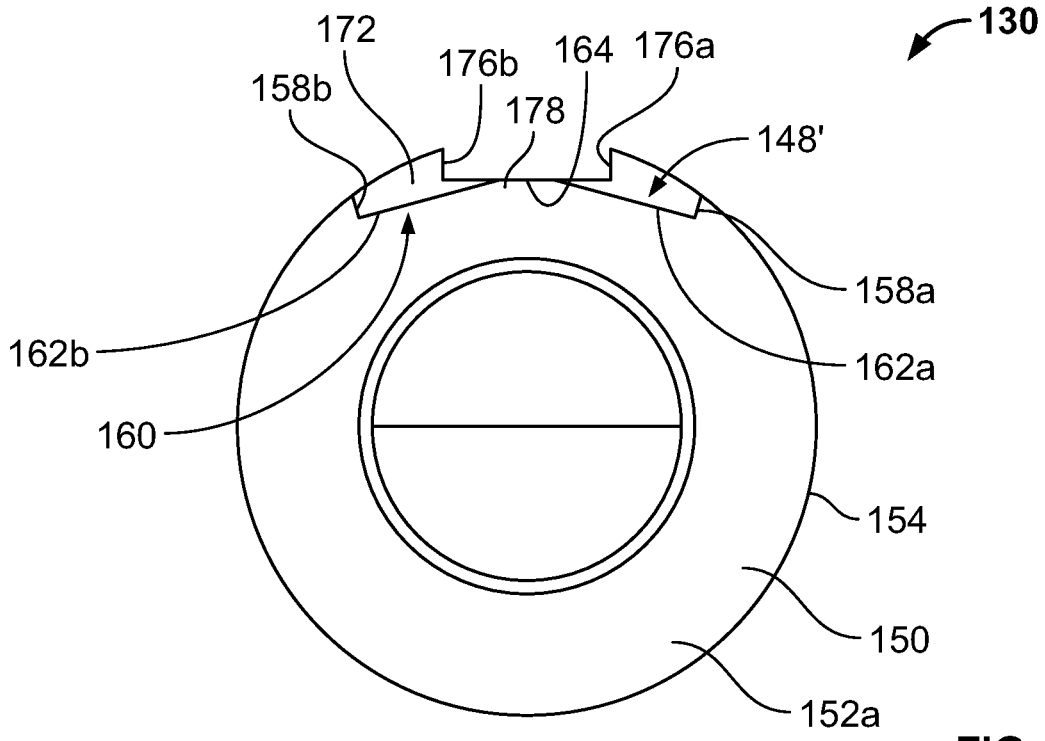
Figure 16:
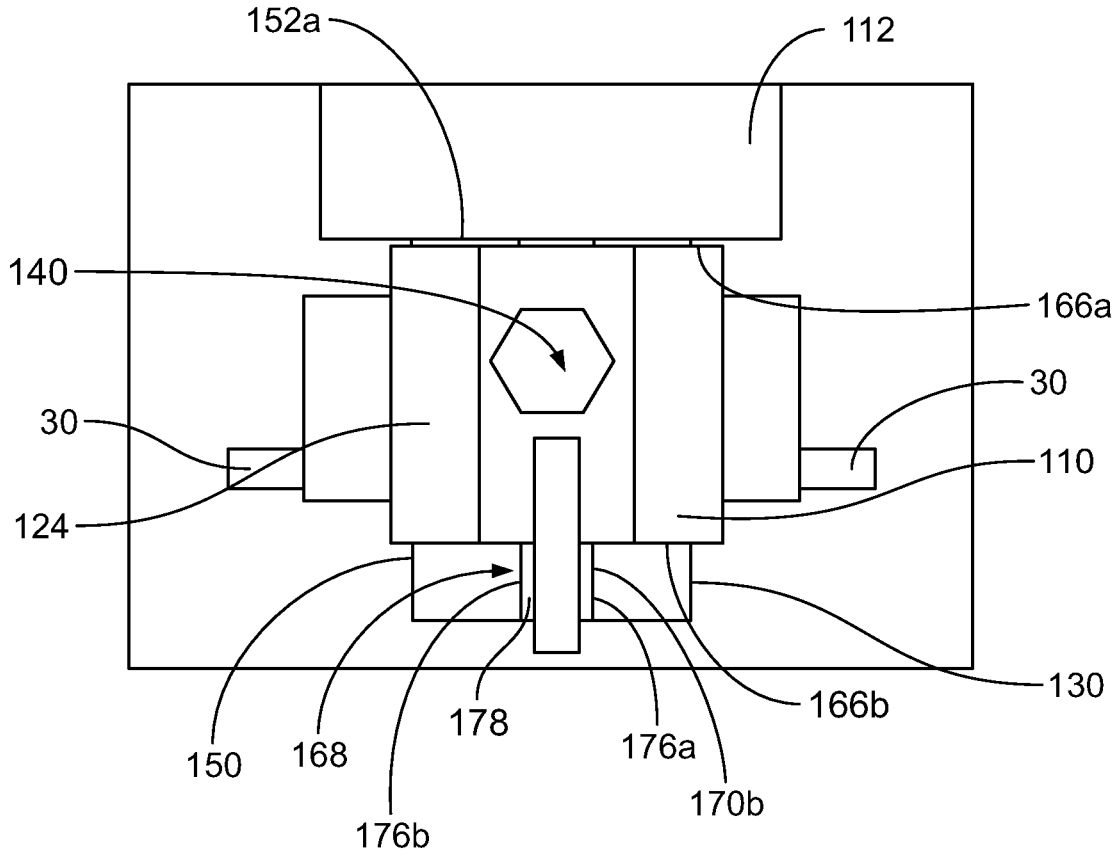
FIG. 16 illustrates a front side view of the recessed retention body of the end cap shown in FIGS. 14 and 15 positioned within an exemplary lower casting or adapter and engaged with a mechanical contact assembly according to some embodiments.

FIGS. 14-16 illustrate another embodiment of a retention body 148' in which the retention body 148' comprises a first body section 170*a* and a second body section 170*b*. According to such an embodiment, the first body section 170*a* can have a configuration that is generally similar to the retention bodies 148 discussed above with respect to at least FIGS. 7 and 13, with the exception that the first body section 170*a* does not extend to the second end 152*b* of the end cap 130. Thus, the first body section 170*a* can include an engagement surface 160 and retention walls 158*a*, 158*b* that have configurations that are similar to the embodiments discussed above. However, rather than extending to the second end 152*b* of the end cap 130, the first body section 170*a* can extend to a shoulder section 172 that is generally located between the first body section 170*a* and the second body section 170*b*. Moreover, the shoulder section 172 can be positioned at a distance from the first end 152*a* of the end cap 130 that is generally similar to the length ("L1") between at least the upper and lower surfaces 166*a*, 166*b* of wall 124 of the lower adapter 110. Such positioning of the shoulder section 172 can generally allow the first body section 170*a* to, at least when the lower adapter 110 is secured to the end cap 130, be positioned along at least the portion of the end cap 130 that is housed within the interior region 128 of the lower adapter 110. Thus, according to such an embodiment, at least a portion of the second body section 170*b* is positioned along least a portion of the end cap 130 that protrudes out from the interior region 128 of the lower adapter 110, as discussed below and as demonstrated, for example, by FIG. 16.

According to the illustrated embodiment, the shoulder section 172 can extend in a direction that is generally different that the direction of the retention walls 158*a*, 158*b* of the first body section 170*a*. For example, while the retention walls 158*a*, 158*b* of first body section 170*a* can extend in a direction that is generally parallel to the central longitudinal axis 156, at least a portion of the shoulder section 172 may generally extend in a direction that is non-parallel, and is possibly generally perpendicular, to the retention walls 158*a*, 158*b* and the central longitudinal axis 156. Additionally, the shoulder section 172 can also include transition regions 174 that join the retention walls 158*a*, 158*b* to the shoulder section 172. While the transition regions 174 can have a variety of shapes, according to the illustrated embodiment, the transition regions 174 can be curved areas of the shoulder section 172 that accommodate a change in direction for the transition between the retention walls 158*a*, 158*b* and the shoulder section 172. Additionally, the shoulder section 172 can have a variety of shapes and configurations in a direction generally between the retention walls 158*a*, 158*b*, including, for example, being straight, curved, or having multiple curvatures joined together, as well as a combination thereof.

Similar to the retention walls 158*a*, 158*b*, at least a portion of the shoulder section 172 can have a height that extends from an adjacent surface of the engagement surface 160 to the outer surface 154 of the wall 150 of the end cap 130. Further, as seen in FIG. 14, the height of the shoulder section 172 can generally increase as the shoulder section 172 inwardly extends away from an adjacent retention wall 158*a*, 158*b* and toward the apex wall or segment 164. Thus, according to certain embodiments, at least a portion of the shoulder section 172 can have a height that can engage the bottom wall 144*b* of the shoe 134 in a manner that can limit the extent that the end cap 130 can pass through the interior region 128 of the lower adapter 110. For example, in the event the force that at least the shoe 134 is asserting against the engagement surface 160 is at a level that can accommodate linear displacement of the end cap 130 within the interior region 128 of the end cap 130, the size and/or configuration of the shoulder section 172 can accommodate the shoulder section 172 contacting the bottom wall 144*b* of the shoe 134 at least as the end cap 110 is linearly displaced in the general direction of the shoe 134 in a manner that can stop or limit such linear displacement of the end cap 130, and thus of the fuse assembly.

According to the illustrated embodiment, the second body section 170*b* can generally extend from the shoulder section 172 to, or around, the second end 152*b* of the end cap 130. Thus, the second body section 170*b* can include sidewalls 176*a*, 176*b* that can extend from the shoulder section 172 and to, or around the second end 152*b* of the end cap 130. Further, according to the illustrated embodiment, the sidewalls 176*a*, 176*b* can extend toward the second end 152*b* in a direction that is generally parallel to the retention walls 158*a*, 158*b* and the central longitudinal axis 156. Further, the sidewalls 176*a*, 176*b* can have profiles that may, or may not be similar to the profiles of the of the retention walls 158*a*, 158*b* as the sidewalls 176*a*, 176*b* extend at least upwardly toward the outer surface 154 of the wall 150 of the end cap 130. For example, as seen by the embodiment illustrated in FIG. 15, while the retention walls 158*a*, 158*b* can extend upwardly and outwardly in diverging directions toward the outer surface 154, the sidewalls 176*a*, 176*b* can extend upwardly toward the outer surface 154 in similar directions such that the sidewalls 176*a*, 176*b* of the second body section 170*b* are generally parallel to each other. Additionally, the sidewalls 176*a*, 176*b* may, or may not, inwardly extend from the outer surface 154 of the wall 150 of the end cap 130 to a depth similar to the depth that the retention walls 158*a*, 158*b* extend from the outer surface 154 of the wall 150 to the engagement surface 160.

The second body section 170*b* can further include an indicator wall 178 that extends between the sidewalls 176*a*, 176*b*, as well as through a portion of the shoulder section 172. According to certain embodiments, the indicator wall 178 can be generally flat. Further, according to certain embodiments, the indicator wall 178 can be coplanar with at least a portion of the engagement surface 160, including, for example, the apex wall or segment 164. Moreover, the second body section 170*b* can be configured such that center location between the sidewalls 176*a*, 176*b* of the second body section 170*b*, and/or a middle section of the indicator wall 178, is generally aligned with the center of the first body section 170*a* in a direction generally parallel with the central longitudinal axis 156. For example, according to certain embodiments, the indicator wall 178 can be positioned such that a centerline of the indicator wall 178 coincides with the centerline or apex of the apex wall or segment 164.

Unlike the first body section 170*a*, which is configured for engagement with the shoe 134 in a manner that can prevent inadvertent rotation of the end cap 130, as previously discussed, the second body section 170*b* can be configured to provide the first visual indicator 168 of the end cap 130. Thus, as the second body section 170*b* may not be configured for engagement with the shoe 134, the second body section 170*b* may have a width between the opposing sidewalls 176*a*, 176*b*, such as, for example, in a direction that is generally perpendicular to the central longitudinal axis, that is smaller than a corresponding width between the retention walls 158*a*, 158*b* the first body section 170*a*, as seen for example, in FIGS. 13 and 15. Additionally, according to certain embodiments, the second body section 170*b* can have a width that is larger than the width of the one or more walls or segments of the apex wall or segment 164, as seen in FIG. 14. Such a width of the second body section 170*b* may assist in the ease with which the installer may see the first visual indicator 168 that is provided by the second body section 170*b*, as well as evaluate whether the first visual indicator 168 is positioned at a location that coincides with the shoe 134 being at a proper angular position relative to the angular orientation of the end cap 130, as illustrated in FIG. 16.

Figure 17:
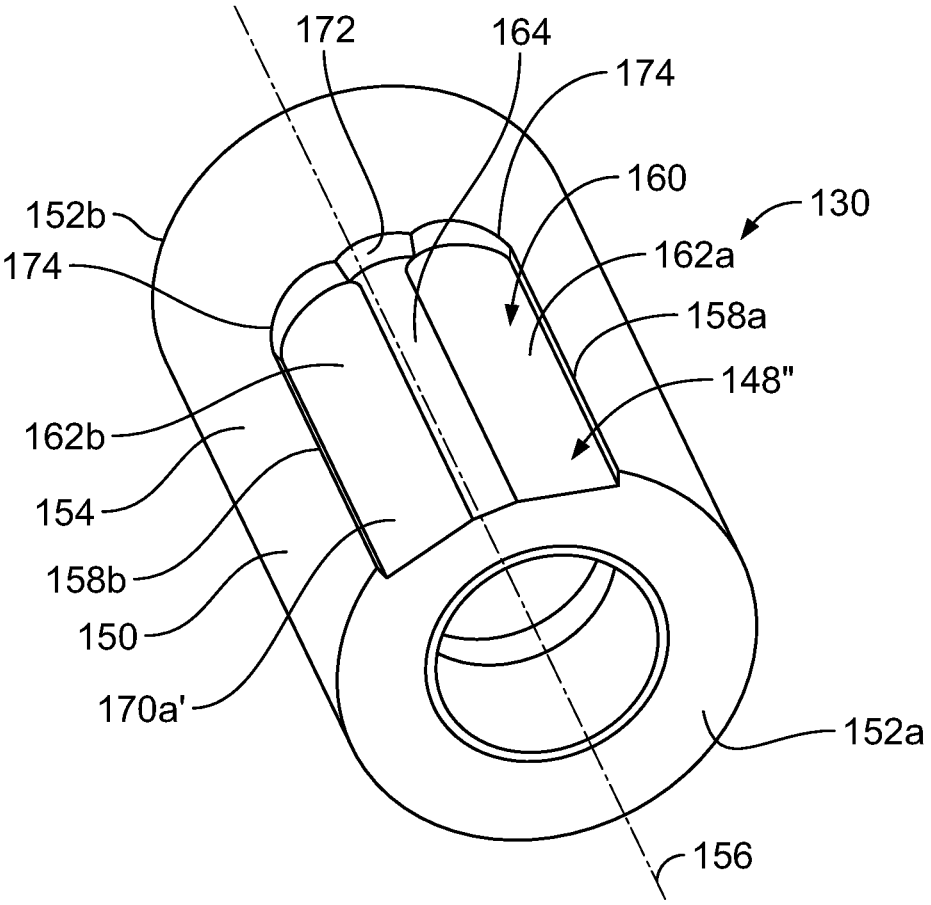
FIGS. 17 and 18 illustrate a front side perspective view and bottom view, respectively, of an exemplary recessed retention body for an end cap of a fuse assembly according to some embodiments.
Figure 18:
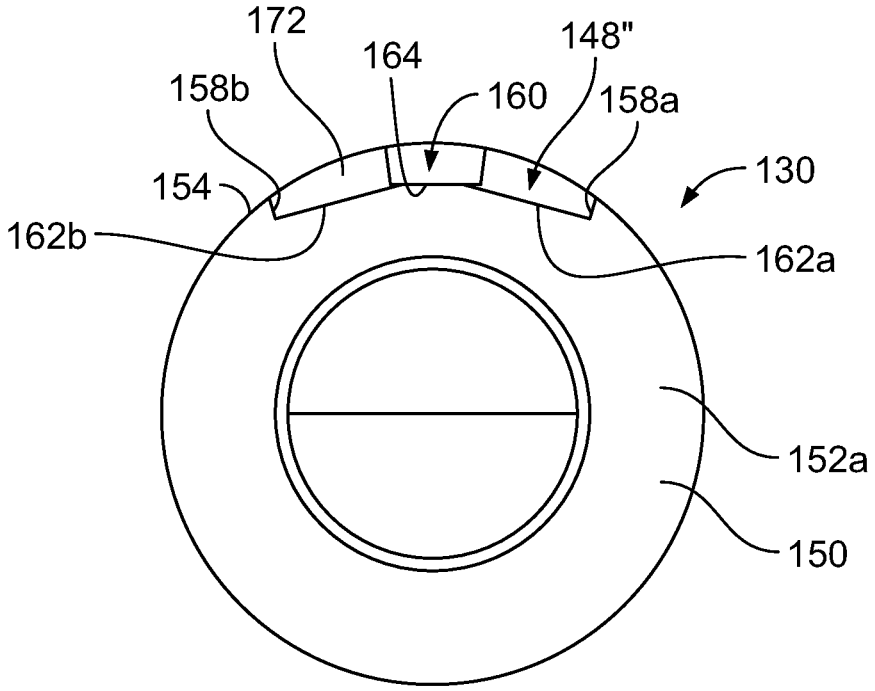

FIGS. 17 and 18 illustrate an embodiment of a retention body 148" having a first body section 170*a*' that is similar to the first body section 170*a* of the retention body 148' illustrated in FIGS. 14-16, but which does not include a second body section 170*b*. Thus, according the embodiment depicted in FIGS. 17 and 18, the retention body 148" extends from the first end 152*a* of the end cap 130 to the shoulder section 172, which again is located between the first and second ends 152*a*, 152*b* of the end cap 130. As with the first body section 170*a* of the retention body 148' illustrated in FIGS. 14-16, according to certain embodiments, the shoulder section 172 depicted in FIGS. 17 and 18 can extend a distance from the first end 152*a* that can correspond to the length ("L1") of the wall 124, and thus interior region 128, of the lower adapter 110. According to such embodiments the end cap 130 may, or may not, have a first visual indicator 168. Alternatively, the shoulder section 172 can extend a distance from the first end 152*a* that is greater than the length ("L1") of the wall 124 of the lower adapter 110 such that at least a portion of the retention body 148" can provide a first visual indicator 168 that is visible on portions of the end cap 130 that are not positioned within the interior region 128 of the lower adapter 110. Again, as with other embodiments, the first visual indicator 168 can be at a location that can provide a visual indicator as to the relative angular positions and alignment of the lower adapter 110 and the end cap 130.

Figure 19:
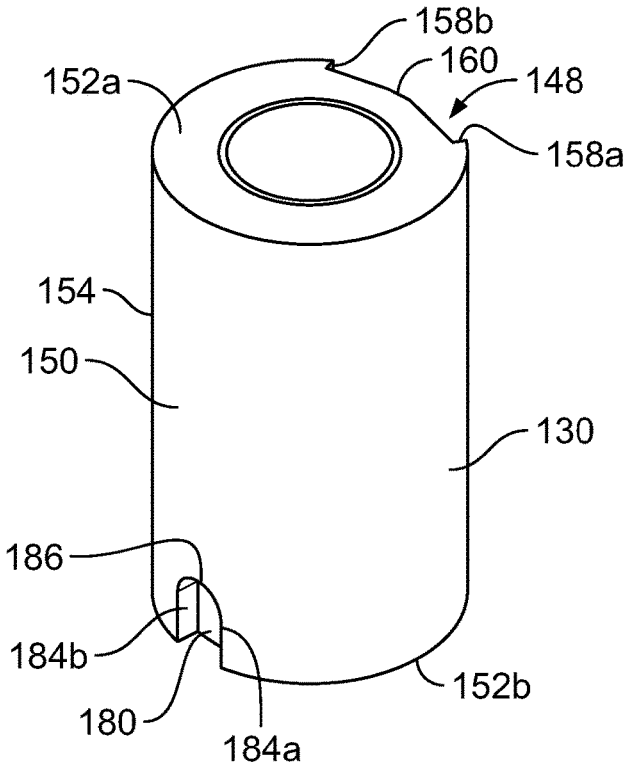
FIG. 19 illustrates a rear side perspective view of an end cap of a fuse assembly having a second visual indicator according to some embodiments.
Figure 20:
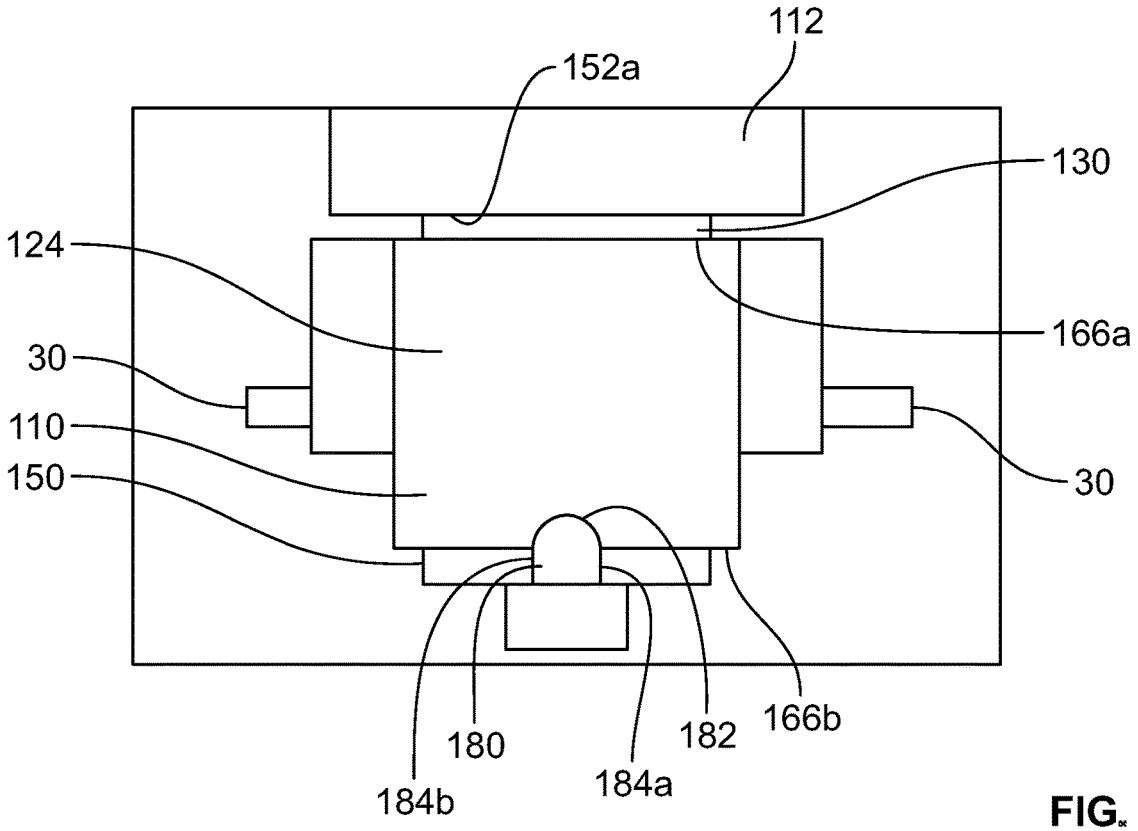
FIG. 20 illustrates a rear side view of the end of a fuse assembly positioned within an exemplary lower casting or adapter and the second visual indicator shown in FIG. 19 being aligned with an alignment feature of the lower casting or adapter according to some embodiments.

Referencing FIGS. 19 and 20, the end cap 130 can also provide one or more other visual indicators on other portions of the end cap 130. For example, as seen in FIG. 19, and optionally, the end cap 130 for each of the foregoing embodiments can include a second visual indicator 180 that is positioned on a side of the end cap 130 that is different that the side of the end cap 130 that includes the retention body 148. 148', 148". For example, according to certain embodiments, the second visual indicator 180 can be on a side of the end cap 130 opposite to the side of the end cap 130 at which the retention body 148 is positioned. Additionally, according to certain embodiments, the second visual indicator 180 can generally be positioned around, as well as extend through, the second end 152*b* of the end cap 130.

The second visual indicator 180 can have a variety of different shapes and sizes. For example, according to certain embodiments, the second visual indicator 180 can be a slot that is machined into the end cap 130, and which includes a pair of opposing sidewalls 184*a*, 184*b* that are joined by a base wall 186 that is positioned at an end of the slot. The second visual indicator 180 can also take a variety of other configurations, such as, for example, being a dimple. Further, as seen in FIG. 20, the lower surface 166*b* of the lower adapter 110 can include an alignment feature, such as, for example, a notch or opening 182 having a size, such as, for example, diameter or width, that is similar to a corresponding size between the sidewalls 184*a*, 184*b* the second visual indicator 180. According to such an embodiment, the second visual indicator 180 is positioned at a location along the end cap 130 such that, when the sidewalls 184*a*, 184*b* the second visual indicator 180 are aligned with the notch or opening 182 of the lower adapter 110, the retention body 148 and shoe 134 are generally in proper angular alignment with each other.

Aspects

Various Aspects are described below. It is to be understood that any one or more of the features recited in the following Aspect(s) can be combined with any one or more other Aspect(s).

Aspect 1. A fuse assembly comprising:

a casing positioned between a first end cap and a second end cap, the first end cap and the second end cap each being an electrical contact that is electrically coupled to a fuse element, the fuse element being housed at least within an interior region of the casing, the first end cap including a recessed retention body positioned along a wall of the first end cap, the recessed retention body comprising a first retention wall, a second retention wall, and an engagement surface, the first retention wall and the second retention wall extending at least in a generally outwardly direction from an adjacent portion of the retention surface to an outer surface of the wall, and extend between a first end and a second end of the first end cap in a direction that is generally parallel to a central longitudinal axis of the fuse assembly, the engagement surface comprising one or more walls that downwardly and outwardly extend in divergent directions from an apex of the engagement surface and toward the corresponding first or second retention wall, the apex being positioned at a central location between the first and second retention walls and extends in a direction that is generally parallel to the central longitudinal axis.

Aspect 2. The fuse assembly of aspect 1, wherein the engagement surface has a convex configuration.

Aspect 3. The fuse assembly of aspect 1, wherein the one or more walls of the engagement surface comprises one or more first descending walls or segments and one or more second descending walls or segments, and wherein the apex is an apex wall or segment, the one or more first and second descending walls or segments extending from opposing sides of the apex wall or segment and being joined to the apex wall or segment at an angle that is less than 180 degrees.

Aspect 4. The fuse assembly of aspect 3, wherein the one or more first descending walls comprises a single wall, and the one or more second descending walls comprises a single wall.

Aspect 5. The fuse assembly of any preceding aspect, wherein the first retention wall and the second retention wall outwardly extend from the engagement surface in diverging directions.

Aspect 6. The fuse assembly of any preceding aspect, wherein the recessed retention body extends from the first end to the second end of the first end cap.

Aspect 7. The fuse assembly of any of aspects 1-5, wherein the recessed retention body extends from the first end of the first end cap to a shoulder section that is positioned between the first end and the second end of the first end cap, the shoulder section extending in one or more directions that are non-parallel to the central longitudinal axis.

Aspect 8. The fuse assembly of any of aspects 1-5, wherein a portion of the recessed retention body extends from the first end to the second end of the first end cap, and wherein another portion of the recessed retention body extends from the first end to a shoulder section that is positioned between the first end and the second end of the first end cap, the shoulder section extending in one or more directions that are non-parallel to the central longitudinal axis.

Aspect 9. The fuse assembly of any preceding aspect, wherein the first end of the first end cap is adjacent to the casing.

Aspect 10. The fuse assembly of any preceding aspect, wherein the engagement surface has a segmented convex configuration.

Aspect 11. The fuse assembly of any preceding aspect, wherein the recessed retention body is asymmetrical in a direction between the first end and the second end of the first end cap.

Aspect 12. The fuse assembly of any preceding aspect, wherein the recessed retention body is positioned along a first side of the first end cap, and wherein the first end cap further includes a visual indicator positioned on a second side of the first end cap, the first side and the second side being opposite sides of the first end cap, the visual indicator extending into a portion of the wall of the first end cap and being positioned around the second end of the first end cap.

Aspect 13. A fuse assembly comprising:

a casing positioned between a first end cap and a second end cap, the first end cap and the second end cap each being an electrical contact that is electrically coupled to a fuse element, the fuse element being housed at least within an interior region of the casing, the first end cap including a retention body recessed into a wall of the first end cap, the recessed retention body comprising:

a first body section comprising a first retention wall, a second retention wall, and an engagement surface, the first and second retention walls extending at least in a generally outwardly direction from an adjacent portion of the retention surface to an outer surface of the wall and extending in a direction that is generally parallel to a central longitudinal axis of the fuse assembly from a first end of the first end cap to a shoulder section of the retention body that is positioned between the first end and a second end of the first end cap, the engagement surface comprising one or more walls that downwardly and outwardly extend in divergent directions from an apex of the engagement surface and toward the corresponding first or second retention wall, the apex being positioned at a central location between the first and second retention walls and extends in a direction that is generally parallel to the central longitudinal axis; and a second body section positioned between the shoulder section and the second end of the first end cap, the second body section having a pair of sidewalls and an indicator wall, the pair of sidewalls extending at least in a generally outwardly direction from an adjacent portion of the indicator wall to the outer surface of the wall, the indicator wall being positioned between the pair of sidewalls and centrally aligned with the apex.

Aspect 14. The fuse assembly of aspect 13, wherein the indicator wall is coplanar with the apex.

Aspect 15. The fuse assembly of aspects 13 or 14, wherein the engagement surface comprises one or more first descending walls or segments and one or more second descending walls or segments that downwardly and outwardly extend in divergent directions from opposing sides of the apex, the one or more first descending walls or segments being non-planar with the one or more second descending walls or segments.

Aspect 16. The fuse assembly of any one of aspects 13-15, wherein the indicator wall extends through the shoulder section, and at least a portion of the shoulder section has a height between the outer surface of the wall and an adjacent portion of the engagement surface that is greater than a height of the first and second retention walls.

Aspect 17. A fuse assembly configured to be secured by a first adapter and a second adapter to a cutout body of a cutout assembly, the fuse assembly comprising:

a casing positioned between a first end cap and a second end cap, the first end cap and the second end cap each being an electrical contact that is electrically coupled to a fuse element, the fuse element being housed at least within an interior region of the casing, the first end cap being configured to be secured within an interior region of the first adapter via at least a force applied against at least a portion of a recessed retention body of the first end cap by a shoe of a contact assembly of the first adapter, the first end cap having a length between a first end and a second end of the first end cap that is longer than a height of the interior region of the first adapter such that at least a portion of the first end cap extends outside the first adapter when the first adapter is secured to the first end cap, the recessed retention body comprising:

a first retention wall, a second retention wall, and an engagement surface, the first and second retention walls being generally parallel to a central longitudinal axis of the fuse assembly and generally downwardly extend from an outer surface of the first end cap to an adjacent portion of the engagement surface, a width between the first retention wall and the second retention wall being similar to a corresponding width of the shoe, the first retention wall and the engagement surface comprising one or more first descending walls or segments and one or more second descending walls or segments that downwardly and outwardly extend in divergent directions from opposing sides of an apex of the engagement surface, the apex being positioned at a central location between the first and second retention walls and extends in a direction that is generally parallel to the central longitudinal axis, at least a portion of the recessed retention body having a length between the first end and the second end of the first end cap that is larger than the height of the interior region of the first adapter.

Aspect 18. The fuse assembly of aspect 17, wherein the recessed retention body extends from the first end of the first end cap, and wherein the recessed retention body further includes a shoulder section positioned between the first and second retention walls and the second end of the first end cap, at least a portion of the shoulder section being non-parallel to the central longitudinal axis.

Aspect 19. The fuse assembly of aspect 18, wherein the recessed retention body further includes a body section positioned between the shoulder section and the second end of the first end cap, the body section having a pair of sidewalls and an indicator wall, the pair of sidewalls extending at least in a generally outwardly direction from an adjacent portion of the indicator wall to the outer surface of the first end cap, the indicator wall being positioned between the pair of sidewalls and centrally aligned with the apex.

Aspect 20. The fuse assembly of aspect 19, wherein the indicator wall extends through the shoulder section and to the second end of the first end cap, and wherein the first end cap further includes a visual indicator recessed into the first end cap at the second end of the first end cap, the visual indicator and the recessed retention body is positioned being positioned at opposing sides of the end cap.

It is to be understood that changes may be made in detail, especially in matters of the construction materials employed and the shape, size, and arrangement of parts without departing from the scope of the present disclosure. This Specification and the embodiments described are examples, with the true scope and spirit of the disclosure being indicated by the claims that follow.

What is claimed is:

1. A fuse assembly comprising:

a casing positioned between a first end cap and a second end cap, the first end cap and the second end cap each being an electrical contact that is electrically coupled to a fuse element, the fuse element being housed at least within an interior region of the casing, the first end cap including a recessed retention body positioned along a wall of the first end cap, the recessed retention body comprising a first retention wall, a second retention wall, and an engagement surface, the first retention wall and the second retention wall extending at least in a generally outwardly direction from an adjacent portion of the retention surface to an outer surface of the wall, and extending between a first end and a second end of the first end cap in a direction that is generally parallel to a central longitudinal axis of the fuse assembly, the engagement surface comprising:

one or more walls that downwardly and outwardly extend in divergent directions from an apex of the engagement surface and correspondingly toward the first retention wall or the second retention wall, the apex being positioned at a central location between the first and second retention walls and extends in a direction that is generally parallel to the central longitudinal axis.

2. The fuse assembly of claim 1, wherein the engagement surface has a convex configuration.

3. The fuse assembly of claim 1, wherein the one or more walls of the engagement surface comprises one or more first descending walls or segments and one or more second descending walls or segments, and wherein the apex is an apex wall or segment, the one or more first and second descending walls or segments extending from opposing sides of the apex wall or segment and being joined to the apex wall or segment at an angle that is less than 180 degrees.

4. The fuse assembly of claim 3, wherein the one or more first descending walls comprises a single wall, and the one or more second descending walls comprises a single wall.

5. The fuse assembly of claim 1, wherein the first retention wall and the second retention wall outwardly extend from the engagement surface in diverging directions.

6. The fuse assembly of claim 1, wherein the recessed retention body extends from the first end to the second end of the first end cap.

7. The fuse assembly of claim 1, wherein the recessed retention body extends from the first end of the first end cap to a shoulder section that is positioned between the first end and the second end of the first end cap, the shoulder section extending in one or more directions that are non-parallel to the central longitudinal axis.

8. The fuse assembly of claim 1, wherein a portion of the recessed retention body extends from the first end to the second end of the first end cap, and wherein another portion of the recessed retention body extends from the first end to a shoulder section that is positioned between the first end and the second end of the first end cap, the shoulder section extending in one or more directions that are non-parallel to the central longitudinal axis.

9. The fuse assembly of claim 1, wherein the first end of the first end cap is adjacent to the casing.

10. The fuse assembly of claim 1, wherein the engagement surface has a segmented convex configuration.

11. The fuse assembly of claim 1, wherein the recessed retention body is asymmetrical in a direction between the first end and the second end of the first end cap.

12. The fuse assembly of claim 1, wherein the recessed retention body is positioned along a first side of the first end cap, and wherein the first end cap further includes a visual indicator positioned on a second side of the first end cap, the first side and the second side being opposite sides of the first end cap, the visual indicator extending into a portion of the wall of the first end cap and being positioned around the second end of the first end cap.

13. A fuse assembly comprising:

a casing positioned between a first end cap and a second end cap, the first end cap and the second end cap each being an electrical contact that is electrically coupled to a fuse element, the fuse element being housed at least within an interior region of the casing, the first end cap including a retention body recessed into a wall of the first end cap, the recessed retention body comprising:

a first body section comprising a first retention wall, a second retention wall, and an engagement surface, the first and second retention walls extending at least in a generally outwardly direction from an adjacent portion of the retention surface to an outer surface of the wall and extending in a direction that is generally parallel to a central longitudinal axis of the fuse assembly from a first end of the first end cap to a shoulder section of the retention body that is positioned between the first end and a second end of the first end cap, the engagement surface comprising one or more walls that downwardly and outwardly extend in divergent directions from an apex of the engagement surface and correspondingly toward the first retention wall or the second retention wall, the apex being positioned at a central location between the first and second retention walls and extends in a direction that is generally parallel to the central longitudinal axis; and a second body section positioned between the shoulder section and the second end of the first end cap, the second body section having a pair of sidewalls and an indicator wall, the pair of sidewalls extending at least in a generally outwardly direction from an adjacent portion of the indicator wall to the outer surface of the wall, the indicator wall being positioned between the pair of sidewalls and centrally aligned with the apex.

14. The fuse assembly of claim 13, wherein the indicator wall is coplanar with the apex.

15. The fuse assembly of claim 13, wherein the engagement surface comprises one or more first descending walls or segments and one or more second descending walls or segments that downwardly and outwardly extend in divergent directions from opposing sides of the apex, the one or more first descending walls or segments being non-planar with the one or more second descending walls or segments.

16. The fuse assembly of claim 13, wherein the indicator wall extends through the shoulder section, and at least a portion of the shoulder section has a height between the outer surface of the wall and an adjacent portion of the engagement surface that is greater than a height of the first and second retention walls.

17. A fuse assembly configured to be secured by a first adapter and a second adapter to a cutout body of a cutout assembly, the fuse assembly comprising:

a casing positioned between a first end cap and a second end cap, the first end cap and the second end cap each being an electrical contact that is electrically coupled to a fuse element, the fuse element being housed at least within an interior region of the casing, the first end cap being configured to be secured within an interior region of the first adapter via at least a force applied against at least a portion of a recessed retention body of the first end cap by a shoe of a contact assembly of the first adapter, the first end cap having a length between a first end and a second end of the first end cap that is longer than a height of the interior region of the first adapter such that at least a portion of the first end cap extends outside the first adapter when the first adapter is secured to the first end cap, the recessed retention body comprising:

a first retention wall, a second retention wall, and an engagement surface, the first and second retention walls being generally parallel to a central longitudinal axis of the fuse assembly and generally downwardly extend from an outer surface of the first end cap to an adjacent portion of the engagement surface, a width between the first retention wall and the second retention wall being similar correspondingly to a width of the shoe, the first retention wall and the engagement surface comprising one or more first descending walls or segments and one or more second descending walls or segments that downwardly and outwardly extend in divergent directions from opposing sides of an apex of the engagement surface, the apex being positioned at a central location between the first and second retention walls and extends in a direction that is generally parallel to the central longitudinal axis, at least a portion of the recessed retention body having a length between the first end and the second end of the first end cap that is larger than the height of the interior region of the first adapter.

18. The fuse assembly of claim 17, wherein the recessed retention body extends from the first end of the first end cap, and wherein the recessed retention body further includes a shoulder section positioned between the first and second retention walls and the second end of the first end cap, at least a portion of the shoulder section being non-parallel to the central longitudinal axis.

19. The fuse assembly of claim 18, wherein the recessed retention body further includes a body section positioned between the shoulder section and the second end of the first end cap, the body section having a pair of sidewalls and an indicator wall, the pair of sidewalls extending at least in a generally outwardly direction from an adjacent portion of the indicator wall to the outer surface of the first end cap, the indicator wall being positioned between the pair of sidewalls and centrally aligned with the apex.

20. The fuse assembly of claim 19, wherein the indicator wall extends through the shoulder section and to the second end of the first end cap, and wherein the first end cap further includes a visual indicator recessed into the first end cap at the second end of the first end cap, the visual indicator and the recessed retention body is positioned being positioned at opposing sides of the end cap.

* * * * *